US010728666B2

(12) United States Patent
Horbach

(10) Patent No.: US 10,728,666 B2
(45) Date of Patent: Jul. 28, 2020

(54) VARIABLE ACOUSTICS LOUDSPEAKER

(71) Applicant: HARMAN INTERNATIONAL INDUSTRIES, INCORPORATED, Stamford, CT (US)

(72) Inventor: Ulrich Horbach, Canyon County, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/329,411

(22) PCT Filed: Aug. 31, 2017

(86) PCT No.: PCT/US2017/049543
§ 371 (c)(1),
(2) Date: Feb. 28, 2019

(87) PCT Pub. No.: WO2018/045133
PCT Pub. Date: Mar. 8, 2018

(65) Prior Publication Data

US 2019/0200132 A1 Jun. 27, 2019

Related U.S. Application Data

(60) Provisional application No. 62/382,212, filed on Aug. 31, 2016.

(51) Int. Cl.
*H04R 3/12* (2006.01)
*G10K 11/34* (2006.01)
(Continued)

(52) U.S. Cl.
CPC ..... *H04R 3/12* (2013.01); *G10K 11/32* (2013.01); *G10K 11/341* (2013.01); *H04R 1/26* (2013.01); *H04R 1/40* (2013.01); *H04R 1/403* (2013.01)

(58) Field of Classification Search
CPC ..... H04R 1/403; H04R 3/12; H04R 2201/40; H04R 2201/401; H04R 25/405; H04S 3/02; H04S 7/302; G10K 11/34; G10K 11/345
See application file for complete search history.

(56) References Cited

U.S. PATENT DOCUMENTS 3,473,428 A 10/1969 Phillips
3,816,830 A * 6/1974 Giannini ..... D06M 15/31 342/374
(Continued)

FOREIGN PATENT DOCUMENTS

CN 105872940 A 8/2016
EP 1061769 A2 * 12/2000 ..... H04R 1/403
(Continued)

OTHER PUBLICATIONS

Gunness, The Designation and Implementation of Line Arrays using Digital Signal Processing (Year: 2003).*
(Continued)

*Primary Examiner* — Davetta W Goins
*Assistant Examiner* — Kuassi A Ganmavo
(74) *Attorney, Agent, or Firm* — Brooks Kushman P.C.

(57) ABSTRACT

A first array of speaker elements is disposed in a cylindrical configuration about an axis and configured to play back audio at a first range of frequencies. A second array of speaker elements is disposed in a cylindrical configuration about the axis and configured to play back audio at a second range of frequencies. A digital signal processor generates a first plurality of output channels from an input channel for the first frequencies, applies the output channels to the first array of speaker elements using a first rotation matrix to generate a first beam of audio content at a target angle about the axis, generates a second plurality of output channels from the input channel for the second frequencies, and
(Continued)

applies the second output channels to the second array of speaker elements using a second rotation matrix to generate a second beam of audio content at the target angle.

14 Claims, 28 Drawing Sheets

(51) Int. Cl.

| | |
|---|---|
| ***G10K 11/32*** | (2006.01) |
| ***H04R 1/40*** | (2006.01) |
| ***H04R 1/26*** | (2006.01) |

(56) References Cited

U.S. PATENT DOCUMENTS

| | | | | |
|---|---|---|---|---|
| 8,139,816 | B2 | 3/2012 | French et al. | |
| 8,295,498 | B2 | 10/2012 | Karlsson et al. | |
| 9,241,213 | B2 | 1/2016 | French et al. | |
| 9,749,747 | B1 * | 8/2017 | Kriegel | H04R 5/02 |
| 2005/0169493 | A1 * | 8/2005 | Horbach | H04R 1/26 381/335 |
| 2006/0159289 | A1 * | 7/2006 | Stiles | H04R 1/26 381/111 |
| 2006/0204022 | A1 | 9/2006 | Hooley et al. | |
| 2008/0130413 | A1 * | 6/2008 | Bachelor | G01S 15/89 367/103 |
| 2008/0155453 | A1 | 6/2008 | Othmer | |
| 2008/0243278 | A1 | 10/2008 | Dalton et al. | |
| 2008/0253577 | A1 | 10/2008 | Eppolito | |
| 2009/0296954 | A1 | 12/2009 | Hooley et al. | |
| 2010/0135505 | A1 * | 6/2010 | Graebener | H04R 1/403 381/82 |
| 2011/0002488 | A1 * | 1/2011 | Van Daele | H04R 5/02 381/307 |
| 2011/0058677 | A1 | 3/2011 | Choi et al. | |
| 2011/0103620 | A1 | 5/2011 | Strauss et al. | |
| 2011/0246148 | A1 | 10/2011 | Gupta et al. | |
| 2012/0030214 | A1 | 2/2012 | Branca et al. | |
| 2012/0185769 | A1 | 7/2012 | Whitley | |
| 2013/0058505 | A1 | 3/2013 | Munch et al. | |
| 2013/0121515 | A1 | 5/2013 | Hooley et al. | |
| 2013/0170647 | A1 | 7/2013 | Reilly et al. | |
| 2013/0230176 | A1 | 9/2013 | Virette et al. | |
| 2013/0259238 | A1 | 10/2013 | Xiang et al. | |
| 2014/0095997 | A1 | 4/2014 | Vu et al. | |
| 2014/0126753 | A1 | 5/2014 | Takumai et al. | |
| 2014/0169569 | A1 | 6/2014 | Toivanen et al. | |
| 2015/0098596 | A1 | 4/2015 | Noah | |
| 2015/0208166 | A1 | 7/2015 | Raghuvanshi et al. | |
| 2016/0205477 | A1 | 7/2016 | Kuribayashi et al. | |
| 2016/0353205 | A1 * | 12/2016 | Munch | H04R 1/403 |
| 2017/0195815 | A1 | 7/2017 | Christoph et al. | |
| 2017/0223447 | A1 * | 8/2017 | Johnson | H04R 1/30 |
| 2018/0060025 | A1 | 3/2018 | Hill et al. | |
| 2018/0063664 | A1 | 3/2018 | Horbach et al. | |
| 2018/0063665 | A1 | 3/2018 | Walker et al. | |
| 2018/0136898 | A1 | 5/2018 | Shi et al. | |

FOREIGN PATENT DOCUMENTS

| | | | |
|---|---|---|---|
| EP | 1962549 | A2 | 8/2008 |
| WO | 2006022379 | A1 | 3/2006 |
| WO | 2016028264 | A1 | 2/2016 |
| WO | 2016048381 | A1 | 3/2016 |
| WO | 2016054099 | A1 | 4/2016 |

OTHER PUBLICATIONS

Moller et al, Circular Loudspeaker Array with controllable directivity (Year: 2010).*

* cited by examiner

300H

| | 1 | 2 | 3 | 4 | 5 | 6 | 7 | 8 | 9 | 10 | 11 | 12 |
|---|---|---|---|---|---|---|---|---|---|---|---|---|
| F1 | 1.0 | 0 | 0 | 0 | 0 | 0 | 0 | 0 | 0 | 0 | 0 | 0 |
| F2 | 0 | 1.0 | 0 | 0 | 0 | 0 | 0 | 0 | 0 | 0 | 0 | 1.0 |
| F3 | 0 | 0 | 1.0 | 0 | 0 | 0 | 0 | 0 | 0 | 0 | 1.0 | 0 |
| F4 | 0 | 0 | 0 | 1.0 | 0 | 0 | 0 | 0 | 0 | 1.0 | 0 | 0 |

FIG. 3H

300I

| | 1 | 2 | 3 | 4 | 5 | 6 | 7 | 8 | 9 | 10 | 11 | 12 |
|---|---|---|---|---|---|---|---|---|---|---|---|---|
| F1 | 0 | 0 | 0 | 1.0 | 0 | 0 | 0 | 0 | 0 | 0 | 0 | 0 |
| F2 | 0 | 0 | 1.0 | 0 | 1.0 | 0 | 0 | 0 | 0 | 0 | 0 | 0 |
| F3 | 0 | 1.0 | 0 | 0 | 0 | 1.0 | 0 | 0 | 0 | 0 | 0 | 0 |
| F4 | 1.0 | 0 | 0 | 0 | 0 | 0 | 1.0 | 0 | 0 | 0 | 0 | 0 |

FIG. 3I

300J

| | 1 | 2 | 3 | 4 | 5 | 6 | 7 | 8 | 9 | 10 | 11 | 12 |
|---|---|---|---|---|---|---|---|---|---|---|---|---|
| F1 | 0 | 0 | 0 | α | β | 0 | 0 | 0 | 0 | 0 | 0 | 0 |
| F2 | 0 | 0 | α | β | α | β | 0 | 0 | 0 | 0 | 0 | 0 |
| F3 | 0 | α | β | 0 | 0 | α | β | 0 | 0 | 0 | 0 | 0 |
| F4 | α | β | 0 | 0 | 0 | 0 | α | β | 0 | 0 | 0 | 0 |

FIG. 3J

VARIABLE ACOUSTICS LOUDSPEAKER

CROSS-REFERENCE TO RELATED APPLICATION

This application is the U.S. national phase of PCT Application No. PCT/US2017/049543 filed on Aug. 31, 2017, which claims the benefit of U.S. Patent Application No. 62/382,212 filed on Aug. 31, 2016, the disclosures of which are incorporated in their entirety by reference herein.

TECHNICAL FIELD

The contemplated embodiments relate generally to digital signal processing and, more specifically, to a variable acoustics loudspeaker, including all aspects of the systems, hardware, software, and algorithms relevant to implementing all functions and operations associated with such techniques.

BACKGROUND

Conventional loudspeakers that employ single drivers per frequency band (typically two-way, up to five-way) exhibit a directivity pattern, which varies with driver sizes, loudspeaker enclosure depth, baffle width and shape, and crossover filter design. The directivity pattern is, in general, strongly frequency-dependent and difficult to control. In particular, vertical lobing may occur because drivers are non-coincident with respect to the radiated wavelength, and directivity widens considerably towards mid- and low frequencies, thus emitting sound energy into all room directions, rather than to the listener, as intended. Normally, acoustic treatment is necessary to dampen unwanted reflections and to assure precise stereo imaging.

SUMMARY

In one or more illustrative embodiments, a first array of speaker elements is disposed in a cylindrical configuration about an axis and configured to play back audio at a first range of frequencies. A second array of speaker elements is disposed in a cylindrical configuration about the axis and configured to play back audio at a second range of frequencies. A digital signal processor is programmed to generate a first plurality of output channels from an input channel for the first range of frequencies, apply the first plurality of output channels to the first array of speaker elements using a first rotation matrix to generate a first beam of audio content at a target angle about the axis, generate a second plurality of output channels from the input channel for the second range of frequencies, and apply the second plurality of output channels to the second array of speaker elements using a second rotation matrix to generate a second beam of audio content at the target angle about the axis.

In one or more illustrative embodiments, a first plurality of output channels are generated from an input channel for a first range of frequencies. The first plurality of output channels are applied, to a first array of M speaker elements disposed in a cylindrical configuration about an axis and handling a first range of frequencies, using a first rotation matrix to generate a first beam of audio content at a target angle about the axis. A second plurality of output channels are generated from the input channel for the second range of frequencies. The second plurality of output channels are applied, to a second array of N speaker elements disposed in a cylindrical configuration about the axis and handling a second range of frequencies, using a second rotation matrix to generate a second beam of audio content at the target angle about the axis.

BRIEF DESCRIPTION OF THE DRAWINGS

So that the manner in which the recited features of the one or more embodiments set forth above can be understood in detail, a more particular description of the one or more embodiments, briefly summarized above, may be had by reference to certain specific embodiments, some of which are illustrated in the appended drawings. It is to be noted, however, that the appended drawings illustrate only typical embodiments and are, therefore, not to be considered limiting of its scope in any manner, for the scope of the various embodiments subsumes other embodiments as well.

FIG. 3H illustrates an example tweeter rotation matrix for an angle of 0°;

FIG. 3I illustrates an example tweeter rotation matrix for an angle of 90°;

FIG. 3J illustrates an example tweeter rotation matrix for an angle between 90° and 120°;

DETAILED DESCRIPTION

Figure 1:
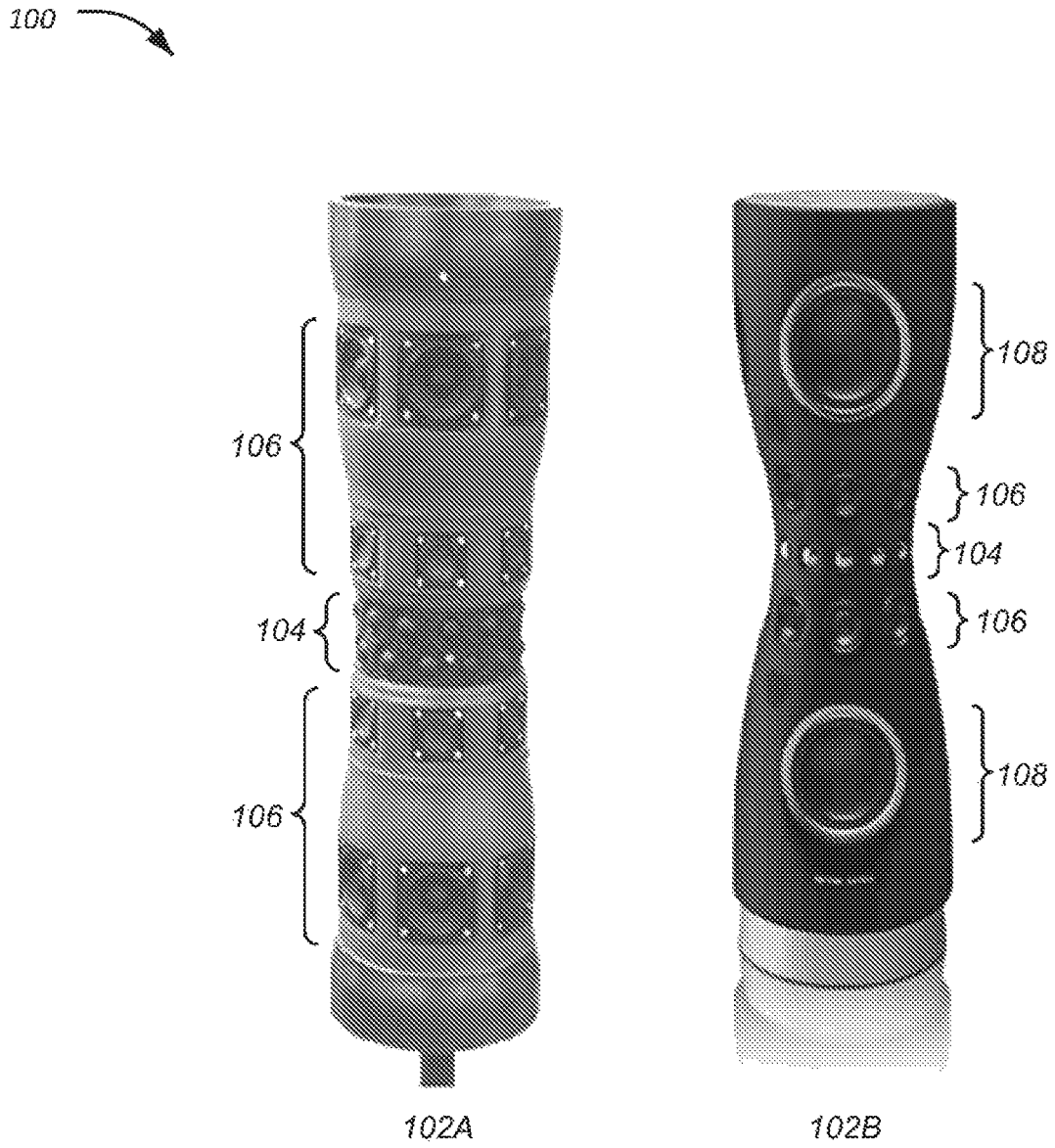
FIG. 1 illustrates example variable acoustics loudspeakers.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The contemplated embodiments relate generally to digital signal processing for use in driving a variable acoustics loudspeaker (VAL) having an array of drivers. In some embodiments, the array of drivers may be disposed in a cylindrical configuration to enable sound beams to be shaped and steered in a variety of different directions. The array of drivers may include, for example and without limitation, tweeters, midranges, woofers, and/or subwoofers. It should be noted that while many examples are roughly cylindrical, different arrangements or axes of driver arrays may be used.

Digital beamforming filters may be implemented in conjunction with the loudspeaker array. For instance, by concentrating the acoustic energy in a preferred direction, a beam is formed. The beam can be steered in a selectable target direction or angle. By forming a beam of both the left and right channels and suitably directing the beams, the intersection of the two beams may form a sweet spot for imaging. In an example, different beam widths may be selected by the user, permitting different sweet spot sizes. Thus, by using the array of drivers, the VAL may be designed to have a precisely-controllable directivity at vertical, horizontal and oblique angles that works in arbitrary rooms, and without room treatment.

The VAL may implement independent control of spatial directivity functions and their frequency dependency. As discussed in detail herein, the VAL may provide for an adjustable size of listening area with a focused sweet spot versus diffuse sound (party mode); natural sound of voices and musical instruments by adapting the correct directivity pattern; natural image of audio objects in a stereo panorama without distraction by unwanted room reflections; a full 360° spherical control of the sound field; an ability to create separate sound zones in a room by assigning different channels to different beams; multichannel playback with a single speaker (using side wall reflections); suppression of rear energy by at least 20 dB down to low frequencies without side lobes (e.g. within 40 Hz to 20 KHz); and a compact size, highly scalable beam control at wavelengths larger than the enclosure dimensions due to super-directive beamforming techniques.

As compared to previous loudspeakers, in the present disclosure an iterative method is applied to beamforming based on measurement data, as opposed to analytical methods based on spatial Fourier analysis as discussed in U.S. Patent Publication No. 2013/0058505, titled "Circular Loudspeaker Array With Controllable Directivity," which is incorporated herein by reference in its entirety. Advantages of the method are higher accuracy, wider bandwidth, direct control over the filter frequency responses, and arbitrary shapes in space and frequency can be prescribed. Additionally, the loudspeaker may provide full-sphere control as opposed to horizontal control only, by combining a cylindrical beamforming array with a vertical array using digital crossover filters. Digital crossover filters are discussed in detail in U.S. Pat. No. 7,991,170, titled, "Loudspeaker Crossover Filter," which is also incorporated herein by reference in its entirety.

FIG. 1 displays an example 100 of variable acoustic loudspeakers 102. A first VAL 102A is shown in a working prototype, and a second VAL 102B as a product realization (collectively VAL 102). The overall shape of the VAL 102 is approximately cylindrical, with arrays of transducers uniformly distributed around it. A central tweeter section with one or two rows of high frequency drivers 104 (e.g., 12 tweeters each), is flanked by one or two pairs of midrange rows 106 (e.g., 6 or 8 drivers), and an optional subwoofer section 108 using two pairs of low-frequency transducers, radiating to the front and rear respectively. Each section (e.g., the tweeter 104, midrange 106, and low-frequency 108 sections) provides individual horizontal beam control in a dedicated frequency band. Vertical control is achieved by optimal crossover design and can be varied by choice of crossover frequencies.

Beamforming is a technique that may be used to direct acoustic energy in a preferred direction. The VAL 102, such as the examples shown in FIG. 1, may use acoustic beamforming to shape a sound field for the VAL 102.

As explained below, a processor (e.g., a digital signal processor/CODEC component) provides the signal processing for beamforming. Input to the signal processor may include mono or left and right stereo channels. Output from the signal processor may include a plurality of channels, the outputs including content based on various filtering and mixing operations to direct the beams from each driver.

For the purpose of beamforming, the frequency bands may be handled separately. In an example, the loudspeaker may separately handle high-frequency, midrange and bass frequencies. As a specific possibility, the high-frequencies may be output from the signal processor in 12 channels to 24 tweeters; the midrange may be output from the signal processor in 8 channels to 8 midrange drivers; and the bass may be output from the signal processor in two channels to 4 bass drivers. In another example, the loudspeaker may be two-way and may separately handle high and low frequencies.

Figure 2:
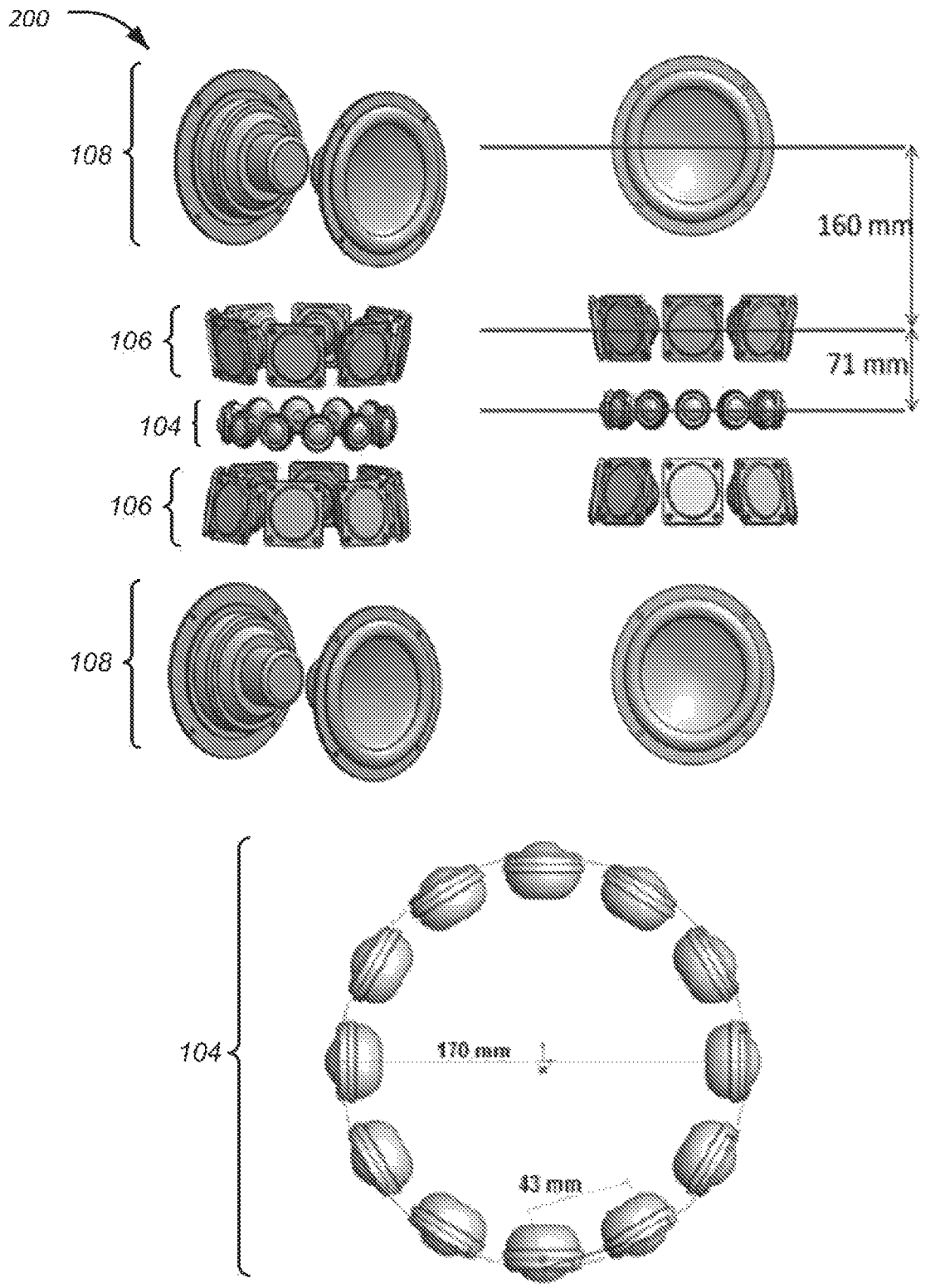
FIG. 2 illustrates example transducer layouts for example variable acoustics loudspeakers.

FIG. 2 provides an example 200 of further details of arrangement and distances of transducers. As shown in the example 200, the center line of the tweeter array 104 is 71 millimeters (mm) from the center line of the midrange arrays 106, and the center line of the midrange arrays 106 is 160 mm from the centerline of the low-frequency array 108. Additionally, in the example 200 the diameter of the tweeter array 104 is 170 mm, and the spacing between tweeter centers is 43 mm.

Figure 3:
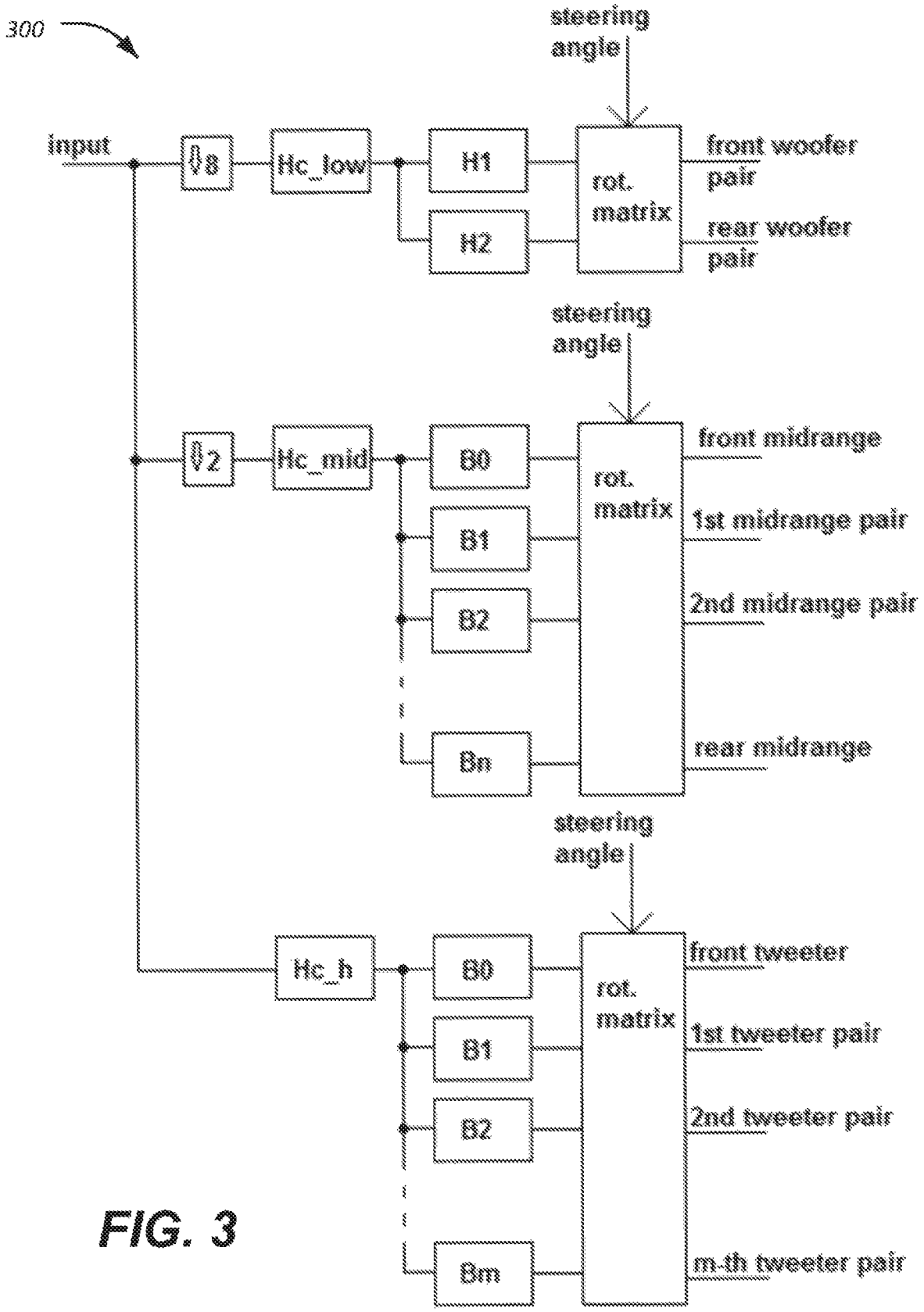
FIG. 3 illustrates a system block diagram for an example variable acoustics loudspeaker.

FIG. 3 provides a system block diagram 300 of the processing performed by a control digital signal processor (DSP) of the system. As shown in the diagram 300, an input may be provided to a sub-sampler for the subwoofer section to be sub-sampled by a factor of eight, in order to reduce filter lengths and save processing power. The sub-sampler is followed by a low-pass crossover filter HC_LOW, then by a pair of beamforming filters H1 and H2 that feed the front subwoofers and rear subwoofers, respectively. Upper and lower transducers are, in general, connected in parallel and to the same filter respective amplifier output.

The midrange and tweeter sections operate similarly, except that there are larger numbers of beamforming filters needed, corresponding to the number of transducers. As shown, the input may also be provided to a sub-sampler for the midrange section to be sub-sampled by a factor of two. The sub-sampler is followed by a band-pass crossover filter HC_MID, then by a set of beamforming filters B0 . . . BN that feed the drivers of the midrange array 106. The input may also be provided to a high-pass crossover filter HC_H, then to a set of beamforming filters B0 . . . BM that feed the drivers of the tweeter array 104. It should be noted that pairs of transducers may be connected to the same filter if a horizontally symmetric beam is desired, and if transducer tolerances can be neglected.

Beamforming is accomplished by selectively filtering different audio frequencies. By applying different filters to the input channel, distinct output channels are generated and routed to different drivers in the cylindrical array. The "rotational matrices" at the outputs allow re-assigning the beamforming filter outputs to different transducers, in order to rotate the beam to a desired angle. For instance, to redirect the beam, the filter outputs to the drivers of the arrays are simply shifted by the appropriate number of positions. To obtain this flexibility, instead of directly connecting the filter outputs to each driver, a rotation matrix or mixing matrix is used to adjust the outputs of the filters before connection to the drivers of the array.

Figure 3B:
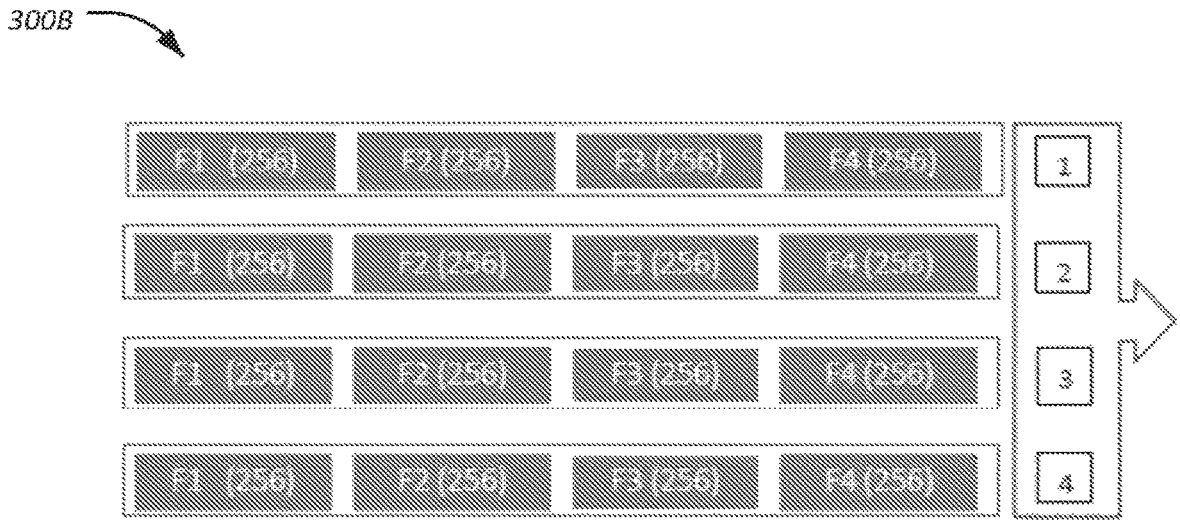
FIG. 3B illustrates an example of four finite input response filters to be used for high-frequency beamforming.

FIG. 3B illustrates an example 300B of four finite impulse response (FIR) filters (F1-F4) of length 256 to be used for high-frequency beamforming. The illustrated filters includes four banks of filters, where each one of the filter banks corresponds to a different beam width. One of the four-filter banks may be selected for the tweeter array based on a beam width parameter$\in\{1, 2, 3, 4\}$. Beam width is discussed in further detail below.

Figure 3E:
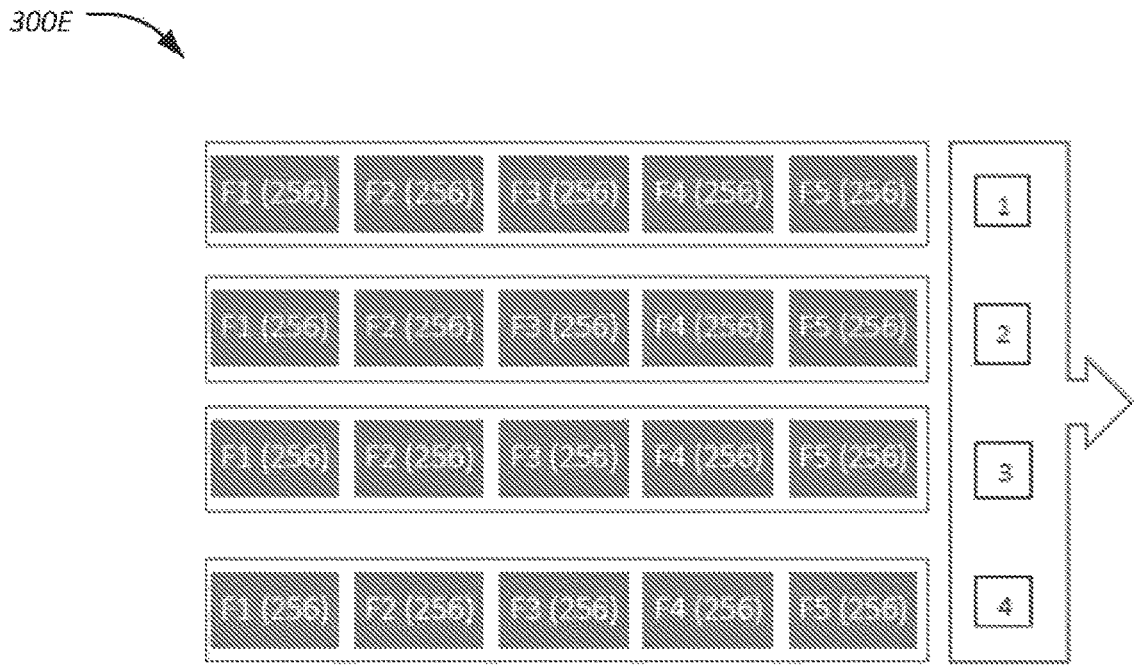
FIG. 3E illustrates an example of five finite input response filters to be used for mid-frequency beamforming.
Figure 3C:
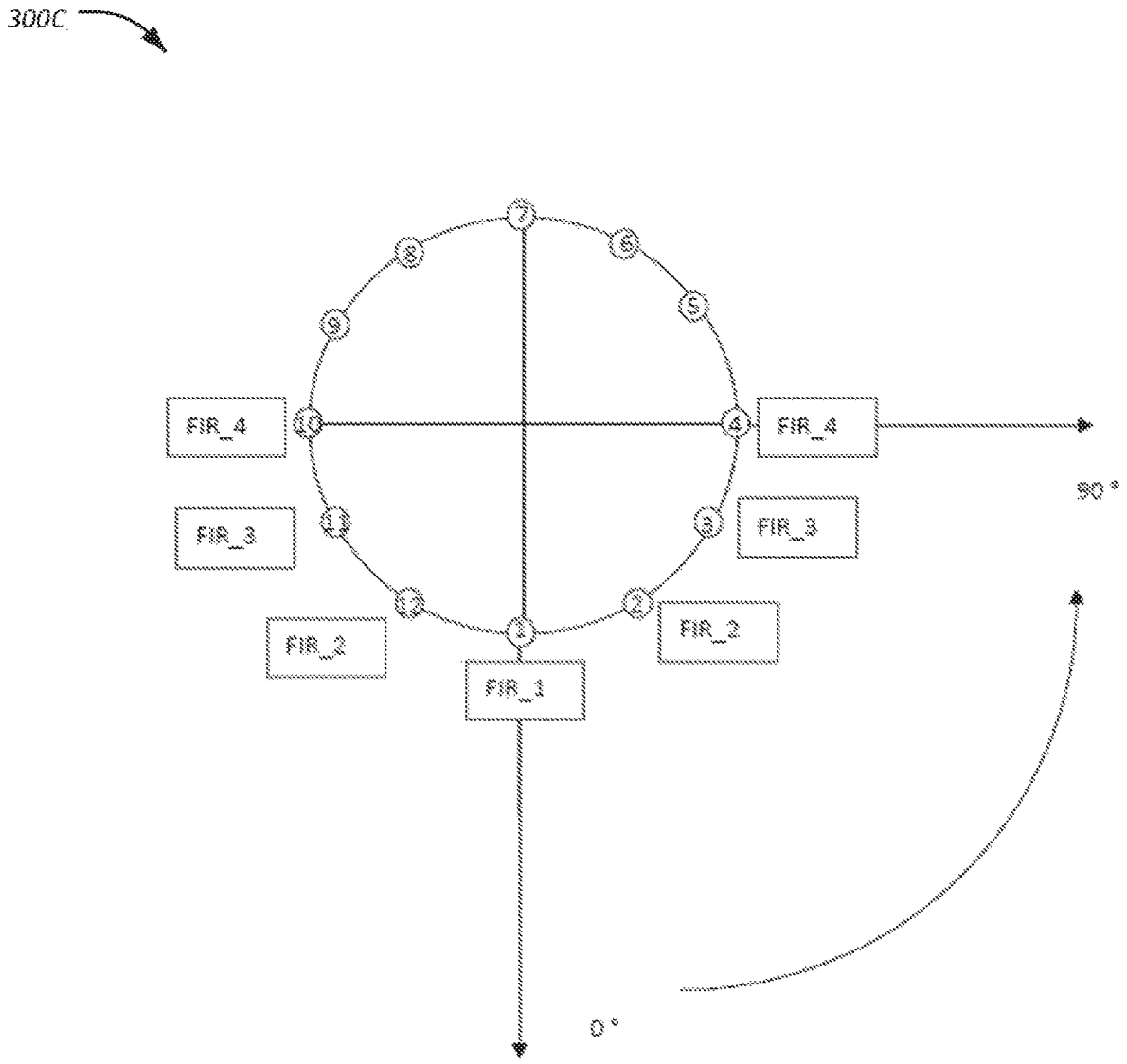
FIG. 3C illustrates an example routing of outputs of the four high-frequency filters to twelve tweeter channels.

FIG. 3C illustrates an example 300C routing of outputs of the four high-frequency filters to twelve tweeter channels. The example twelve tweeter drivers are arranged and numbered as in the diagram. The beam angle is 0°, directed down in the diagram. The boxes show the filter outputs routed to each driver for this configuration. In this case, Node 1 is said to be the head.

In the example, to generate the beam at 0°, the outputs of the four filters are routed to 12 channels as shown in the example 300C. The speaker unit is assumed to be aligned with driver number 1 facing forward. Filter F1 is directed to driver #1; filter F2 is routed to the channels adjacent to driver #1, to drivers #12 and #2; filters F3 and F4 are similarly symmetrically routed.

Figure 3D:
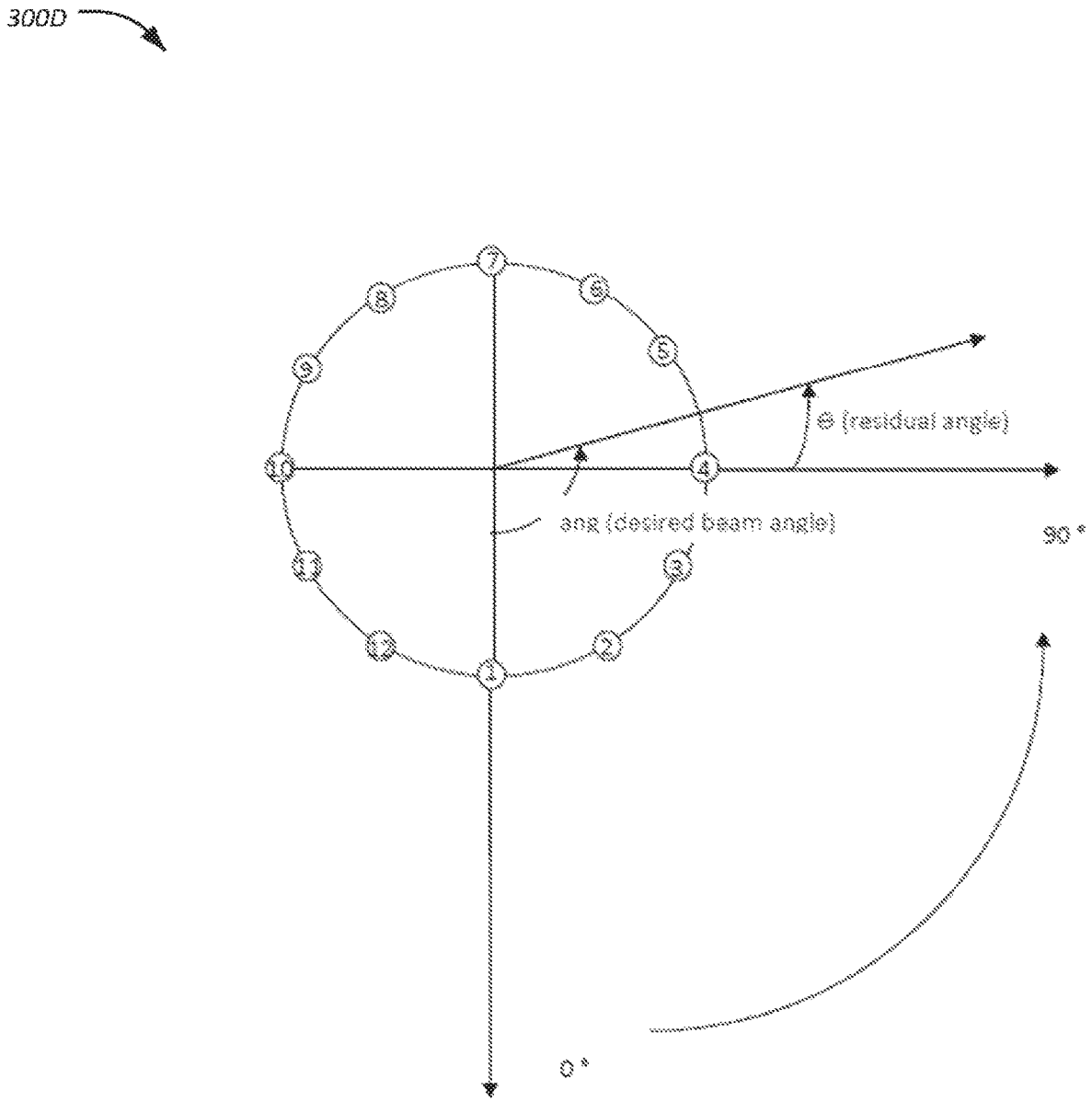
FIG. 3D illustrates an example redirection of the beam to a target angle.

FIG. 3D illustrates an example redirection 300D of the beam to a target angle. In the example 300D, angle of redirection of the beam is shown as being counterclockwise to front-facing, but this is arbitrary and other standards could be used. As the example illustration includes twelve equidistant drivers in the array, each driver in the array is 30° offset from the previous driver. It follows that to rotate the signal 30°, the filter outputs are shifted by one position. If the beam is rotated by n×30°, then the head and the filter mappings advance by n nodes. In an example, to rotate the signal 90°, the filter outputs are shifted by three positions. To do so, the F1 output may be rotated to drive tweeter #4, and the F2 output may be rotated to drive tweeters #3 and #5, etc. (The driver containing the output of F1 may be referred to as the head driver). Angles that are not multiples of 30° are achieved by mixing the surrounding filters using a scheme of linear interpolation. In an example, the residual angle that is less than an offset amount between the drivers, (in this example, 30° offset), may be computed and then adjusted for via interpolation.

FIG. 3E illustrates an example 300E of five FIR filters (F1-F5) of length 256 to be used for mid-frequency beamforming. Similar to as discussed with the high-frequency filters, the illustrated mid-frequency filters includes four banks of filters, where each one of the filter banks corresponds to a different beam width.

Figure 3F:
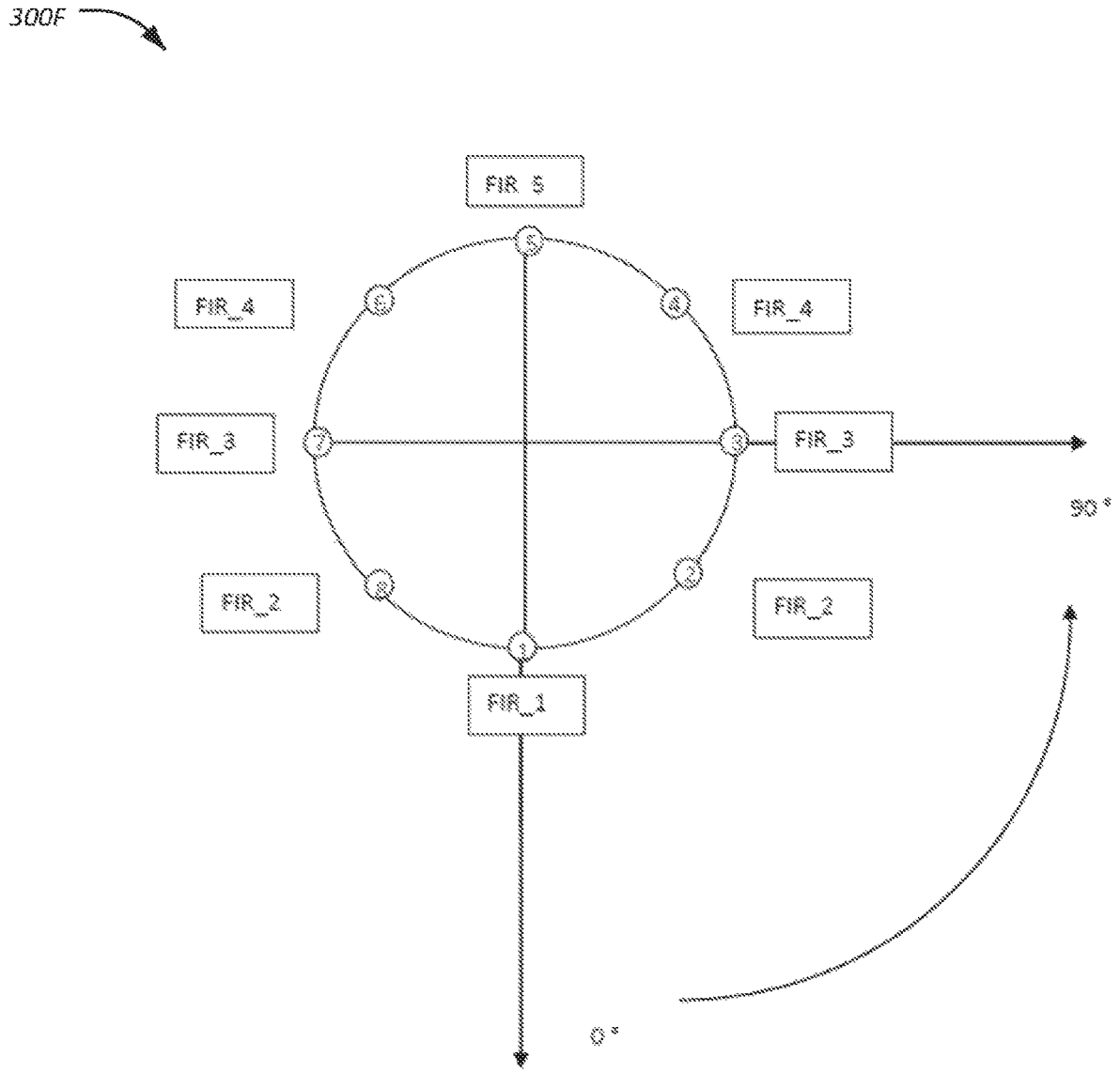
FIG. 3F illustrates an example routing of outputs of the five mid-frequency filters to eight midrange channels.

FIG. 3F illustrates an example 300F routing of outputs of the five mid-frequency filters to eight midrange channels. As shown, the eight midrange drivers are arranged and numbered as in the diagram. The default beam angle is 0°, directed down in the diagram. The boxes show the filter outputs routed to each driver for this configuration. In this case, Node 1 is said to be the head. The example 300F also uses the example counterclockwise convention for angle. Here, as there are eight drivers, shifting by one node results in a change of 45°. Also similar to as discussed above, angles that are not multiples of 45° are achieved by mixing surrounding filters by linear interpolation.

As mentioned above with respect to selection of one of the filter banks, the VAL 102 supports four different beam sizes. For the tweeter and midrange frequencies, there is a different set of filters for each size. For bass processing, however, a different scheme is used. There are only two bass channels. One is sent to 2 woofers facing front (beam #1), the other is sent to 2 woofers facing the rear (beam #2). There are two 512 tap FIR filters that remain fixed. The output of each channel is determined by a linear mix whose coefficients are a function of the beam angle and the beam width.

Figure 3G:
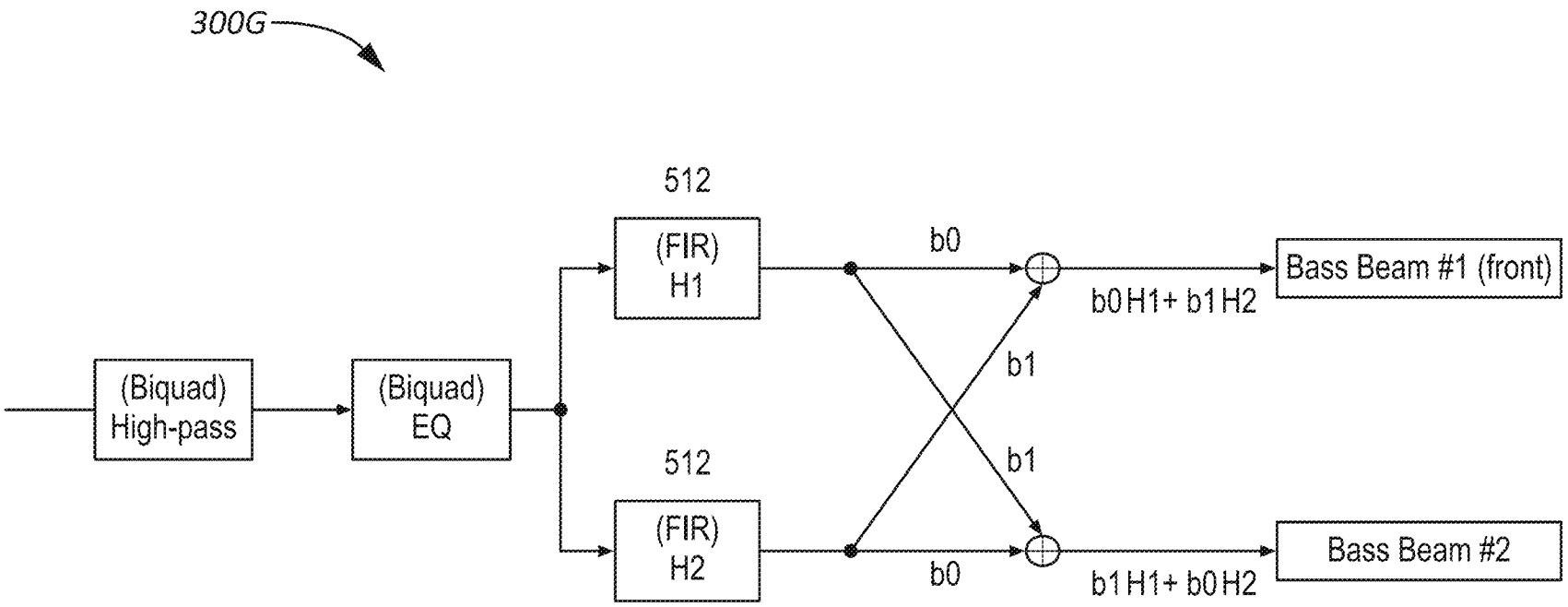
FIG. 3G illustrates signal flow of low-frequency beamforming filters.

FIG. 3G illustrates H1 and H2 which represent the transfer functions of the respective 512 tap filters (after passing through two biquads). The algorithm, as described, permits some directionality to be imposed on audio frequencies down to about 85 Hz. Mathematically, $$b0(\theta) = \frac{1}{1+a}\left[\frac{(a-1)\theta}{180} + 1\right] \text{ and } b1(\theta) = \frac{1}{1+a}\left[\frac{(a-1)\theta}{180} + a\right],$$

where a is one of 0, 0.15, 0.3, or 0.75 depending on beam width and θ is the beam angle in degrees.

The circular arrangement of tweeter and midrange drivers permits the beam to be steered in a coarse manner by a circular shuffle of the filter outputs. In the example of twelve tweeters and eight midranges, the tweeter beam can be moved in this manner by increments of 30°, and the midrange by increments of 45°. To obtain this flexibility, instead of directly connecting the filter outputs to each driver, a mixing or rotating matrix is used. Rotating matrices may be seen in FIG. 3 between the outputs of the filters and the inputs to the drivers.

FIG. 3H illustrates an example tweeter rotation matrix 300H for an angle of 0°. Corresponding to FIG. 3C, as can be seen in the matrix 300H, driver 1 is the head driver receiving the output from filter F1, while the drivers flanking the head driver receive the outputs from the next consecutive filters.

FIG. 3I illustrates an example tweeter rotation matrix 300I for an angle of 90°. As can be seen in the matrix 300I, driver 4 is the head driver receiving the output from filter F1, while the drivers flanking the head driver receive the outputs from the next consecutive filters.

FIG. 3J illustrates an example tweeter rotation matrix 300J for an angle between 90° and 120°. In order to effect finer control, linear interpolation may be used based on the fractional relationship of the "in-between" angles to the neighboring drivers.

Referring back to FIG. 3D, an angle ang is shown that is in between 90° and 120° for a tweeter beam. The residual angle θ may, accordingly, be defined as (ang modulo 30). The weighting factors α and β are defined from θ. To explain mathematically, head=1+ang div 30, where θ=ang modulo 30, β=θ/30, and α=1−β. In the illustrated example, the head=4 for the pictured beam angle, where the lower indices are weighed by α, and the higher indices are weighted by β. Thus, as compared to the rotation matrix 300I, in the rotation matrix 300J the is have been replaced by α, and their successor node entries have been changed from 0 to β.

Figure 4:
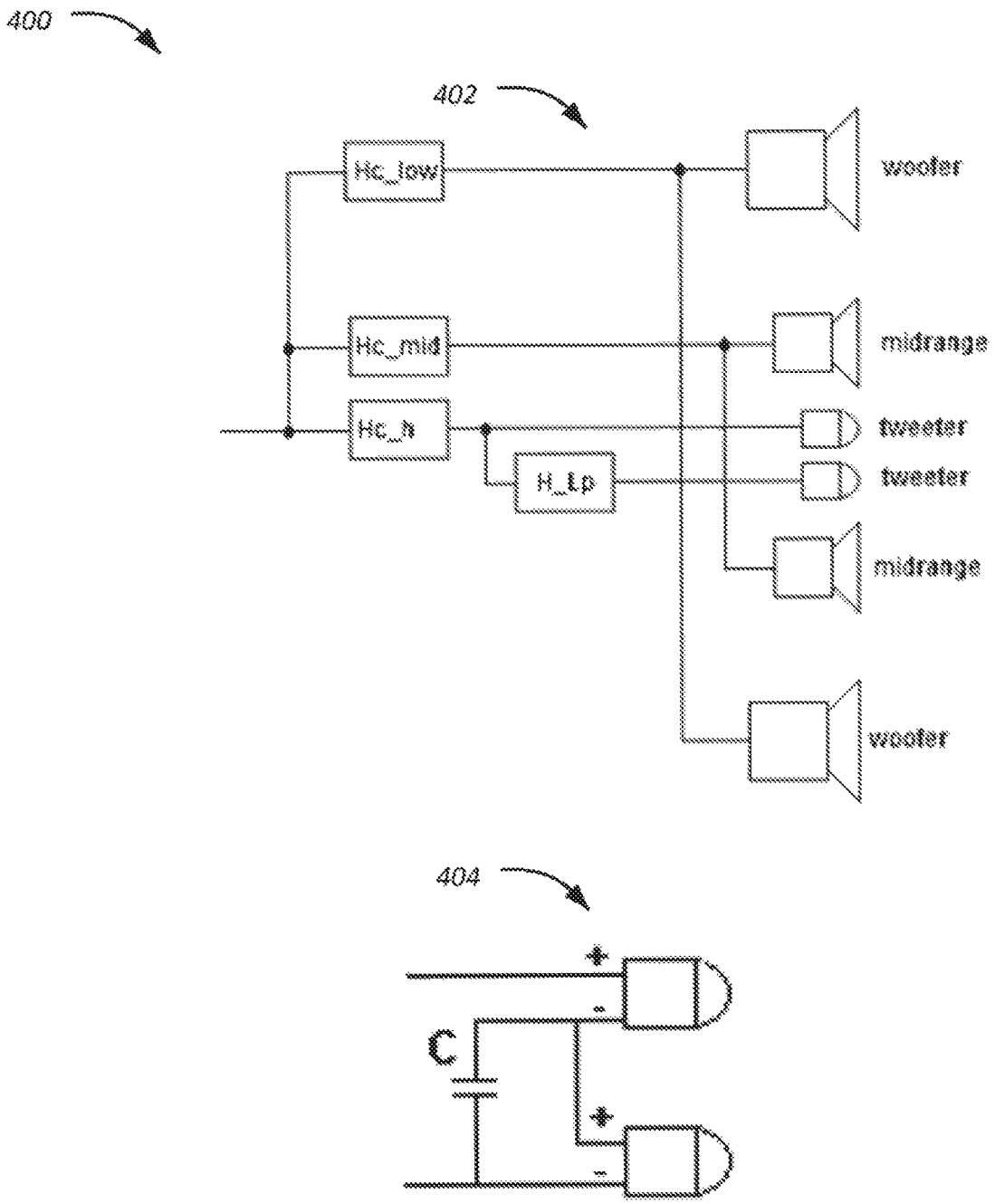
FIG. 4 illustrates an example vertical crossover filter and passive tweeter filter for an example variable acoustics loudspeaker.

FIG. 4 illustrates an example 400 vertical crossover filter and passive tweeter filter for an example variable acoustics loudspeaker. Regarding vertical beam control, the VAR 102 may achieve approximately constant directivity in vertical off-axis angles by applying a symmetric array of tweeters, midranges, and woofers, as shown in FIGS. 2 and 4. Further aspects of the design of the crossover filters may be found in U.S. Pat. No. 7,991,170, as mentioned above.

An attenuation factor a can be prescribed for an acoustic response H at a vertical off-axis angle α as follows:

$$H(f)=a \tag{1}$$

where for example a=0.25; and α=45°. With a crossover function w(f):

$$H(f)=w(f)\cdot C_2(f)+(1-w(f))\cdot C_1(f) \tag{2}$$

$$C_{1/2}(f)=2\cdot\cos(2\pi\cdot d_{1/2}/\lambda) \tag{3}$$

$$d_{1/2}=x_{1/2}\cdot\sin\alpha \tag{4}$$

where $C_{1/2}$ are models for pairs of point sources, the acoustic wavelength is $$\lambda = \frac{c}{f},$$

c=346 m/sec (the speed of sound), and $x_{1/2}$ models the distances between midrange and tweeter pairs, respectively.

From Equation (1), the crossover function w(f) can be computed as follows:

$$w(f) = \frac{a - C_1(f)}{C_2(f) - C_1(f)} \tag{5}$$

Figure 5:
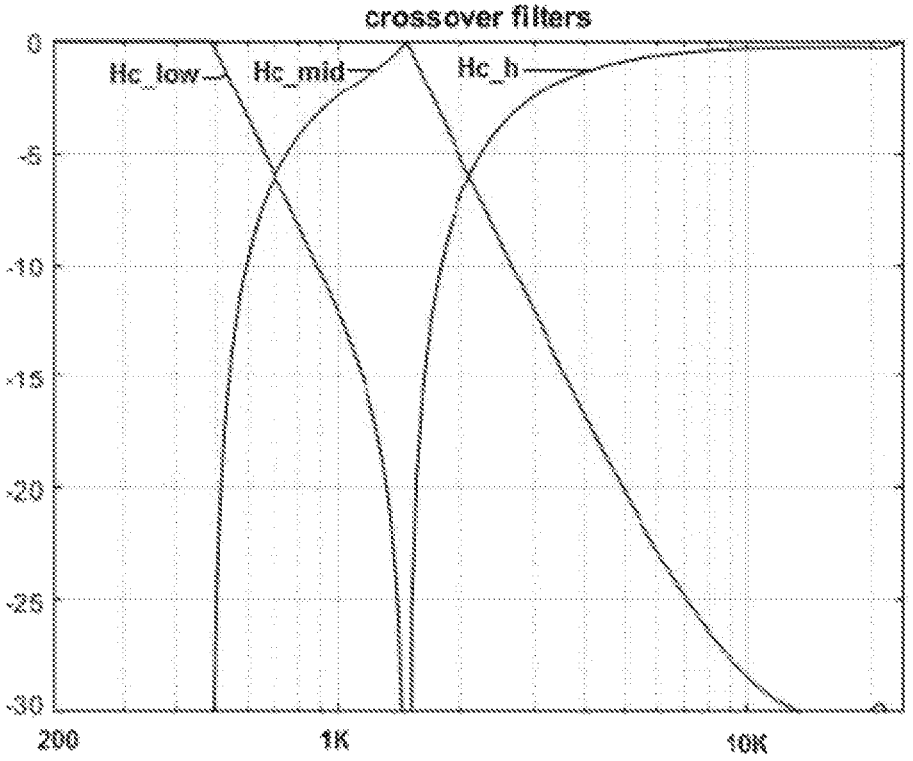
FIG. 5 illustrates an example of crossover frequency responses for an example variable acoustics loudspeaker.

FIG. 5 shows an example 500 of the three-way crossover as depicted in FIG. 4, designed using the above formula. The crossover filters have been derived from the crossover transfer functions w(f), further aspects of which are discussed in U.S. Pat. No. 7,991,170, as mentioned above.

Figure 6:
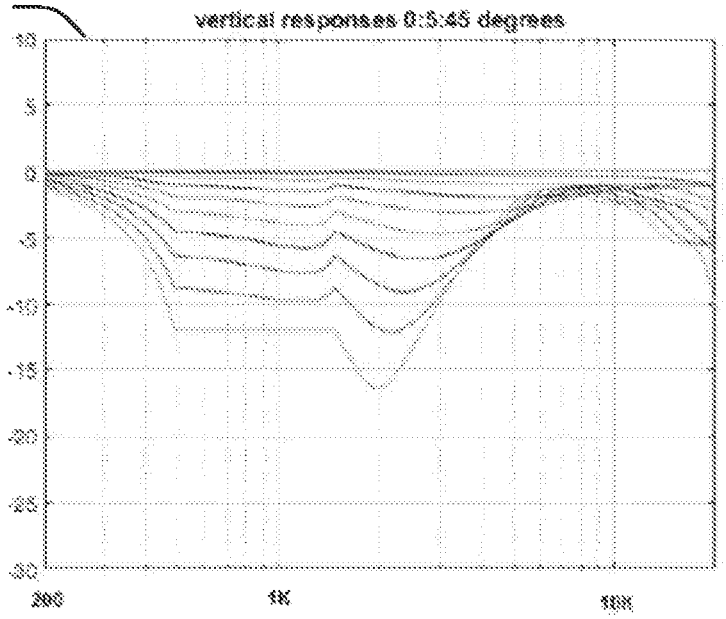
FIG. 6 illustrates example vertical responses for example variable acoustics loudspeakers having one or two tweeter rows.
Figure 6:
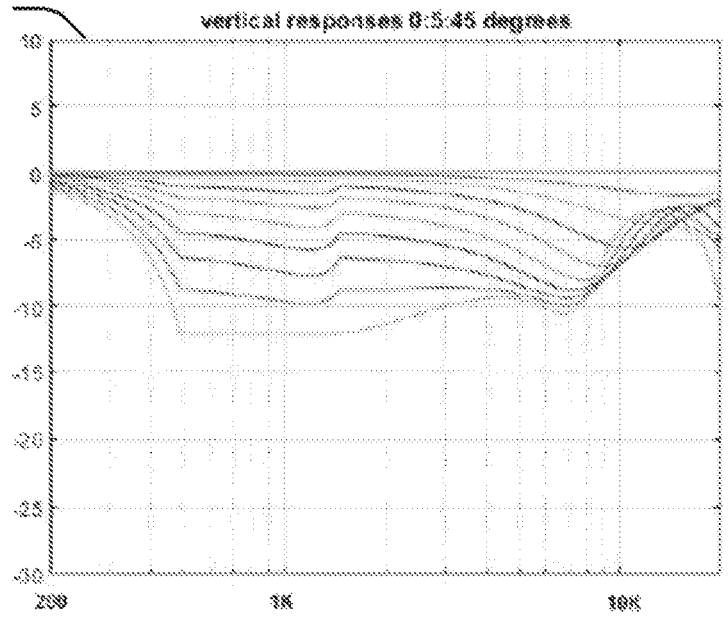

FIG. 6 illustrates example vertical responses 600 for example variable acoustics loudspeakers having one or two tweeter rows. As the trace 602 shows, the VAL 102 may only achieve constant directivity up to about 3 KHz, which is the point where the tweeters take over. This can be improved by adding a second row of tweeters close to the first row, as shown in the VAL 102A of FIG. 1 and in FIG. 4. The second tweeter row is fed by a low pass filtered signal, using a first order crossover H_Lp. This filter can simply be realized with a serial connection and a bypass capacitor C (typically 5-10 uF), as modeled in the schematic 404 of FIG. 4. The trace 604 demonstrates that by adding a second tweeter row at a vertical distance of about 30 mm, constant directivity can be extended up to 10 KHz.

Regarding horizontal beam control at low frequencies, in order to keep enclosure size small and limit the number of transducers, a fixed, cardioid-like beam pattern with prescribed rear attenuation above a certain frequency point may be utilized, instead of the more complex patterns in mid and high frequency bands.

Figure 7:
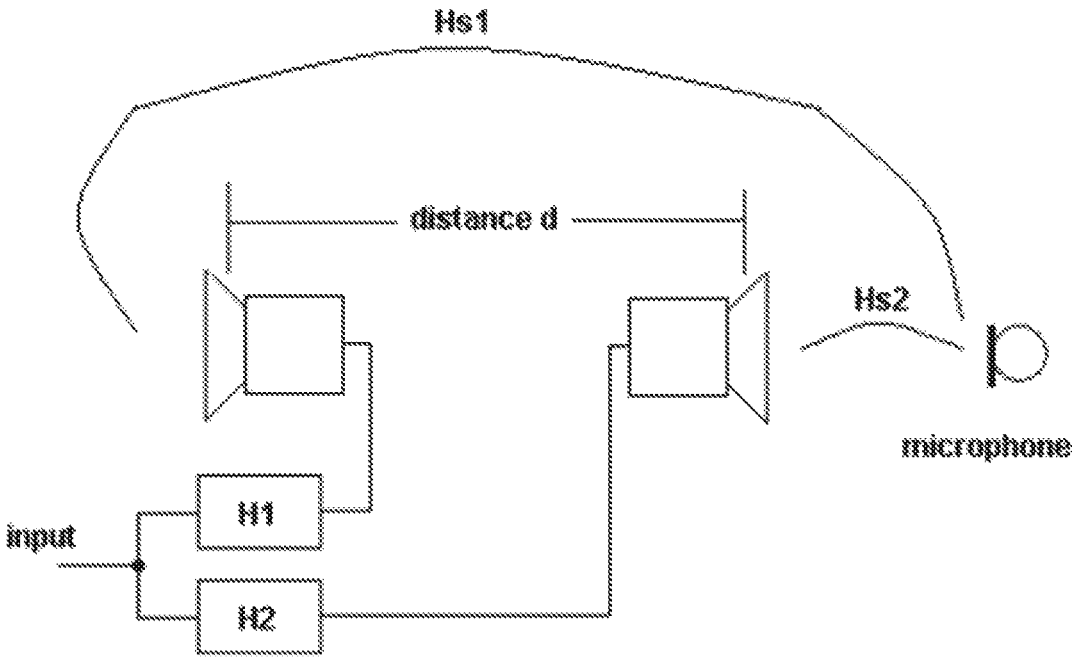
FIG. 7 illustrates an example cardioid woofer functional block diagram for an example variable acoustics loudspeaker.

FIG. 7 illustrates an example cardioid woofer functional block diagram 700 for an example variable acoustics loudspeaker 102. In an example, the woofer pair of FIG. 2 as shown in FIG. 7 is built into a shared, sealed enclosure with a defined distance d between the woofers. A test microphone in an anechoic chamber may be used to measure the transducer response of the woofer that faces the microphone $H_{S2}$, then the response from the opposite woofer $H_{S1}$. A pair of woofer filters $H_1$ and $H_2$ may therefore be designed, with a goal to minimize sound pressure at one side, while maximizing sound pressure at the other side. With these conditions:

$$H_1H_{S1}+H_2H_{S2}=H_{rear} \tag{6}$$

$$H_1H_{S2}+H_2H_{S1}=H_{front} \tag{7}$$

Equations (6) and (7) yield filter transfer functions as follows:

$$H_2 = \frac{H_{front}H_{S1} - H_{rear}H_{S2}}{H_{S1}^2 - H_{S2}^2} \tag{8}$$

$$H_1 = \frac{H_{rear} - H_2H_{S2}}{H_{S1}} \tag{9}$$

For instance, values of $H_{rear}$=0.05 (−20 dB), and $H_{front}$=1 may be set. Further, in order to limit gain and pre-condition the filters, band-limiting frequency points $f_1$=80 Hz, $f_2$=300 Hz may be introduced, and it may be set that:

$$H_{1,2}(f)=H_1(f_1)<f-f_1 \tag{10}$$

$$H_{1,2}(f)=H_{1,2}(f_2)f>f_2 \tag{11}$$

Finite impulse response (FIR) filters can then be obtained by inverse Fourier transform and time-domain windowing. Filter orders are typically below 1K for a small sized woofer enclosure and (80 . . . 300) Hz bandwidth.

Figure 8:
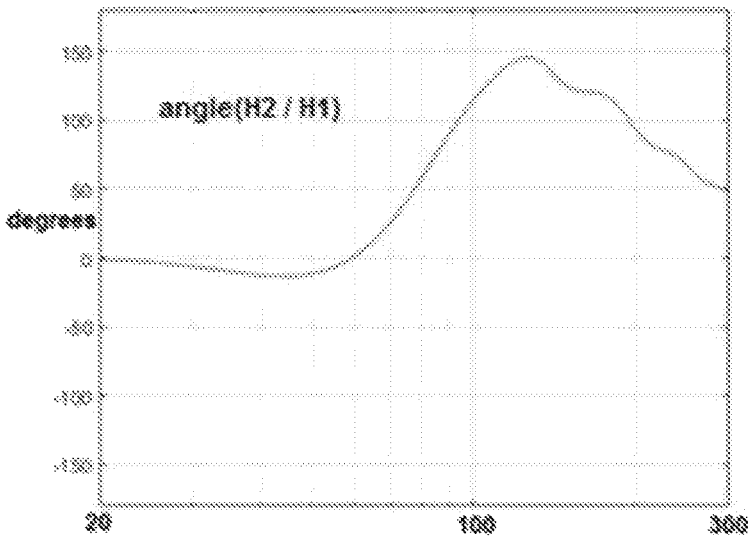
FIG. 8 illustrates an example of phase differences between two beamforming filters for an example variable acoustics loudspeaker.
Figure 9:
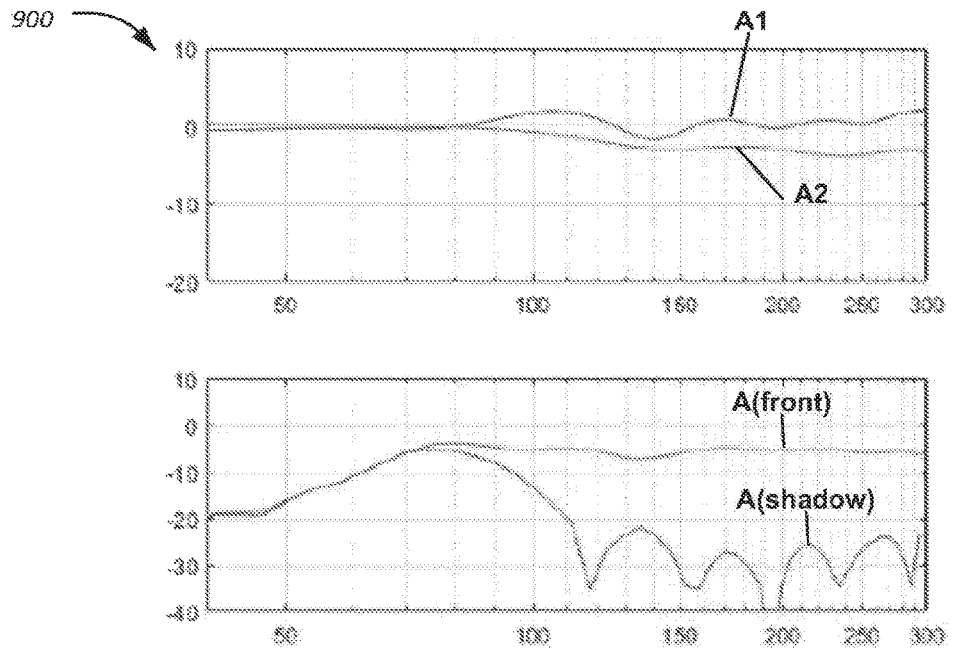
FIG. 9 illustrates example filter magnitude functions and resulting acoustic responses for the cardioid woofer section of an example variable acoustics loudspeaker.

FIG. 8 shows the frequency response 800 of the phase difference between the two woofer filters. FIG. 9 shows log-magnitude frequency responses $A_{1,2}$=20 log|$H_{1,2}$|, and below the resulting acoustic responses at front and rear. Using such a design, 20 dB attenuation above about 100 Hz may be achieved, while keeping the necessary gain low and identical at low frequencies, thereby maintaining full dynamic range. Below 100 Hz, there is a smooth transition towards omni-directional radiation.

With regard to horizontal beam control at mid and high frequencies, the far field sound pressure P at horizontal angles φ around a long cylinder of radius a, with a short, rectangular membrane of angular radius α built in as sound source, can be computed as follows (as discussed in Earl. G. Williams, *Fourier Acoustics*, Academic Press 1999)

$$P(\varphi) \approx \sum_{n=-K}^{K} \frac{-j^n sinc(n\alpha)}{H_n'(ka)} e^{jn\varphi} \tag{12}$$

Where:

$$\text{sinc}(x):=\sin x/x;$$

$$H_n'(z) = \frac{nH_n(z)}{z} - H_{n+1}(z)$$

is the derivative of the Hankel function of the first kind $H_n$;

k=2πf/c is the wave number; and

K is the number of terms to be computed for sufficient accuracy (K=30 in one typical example).

Figure 10:
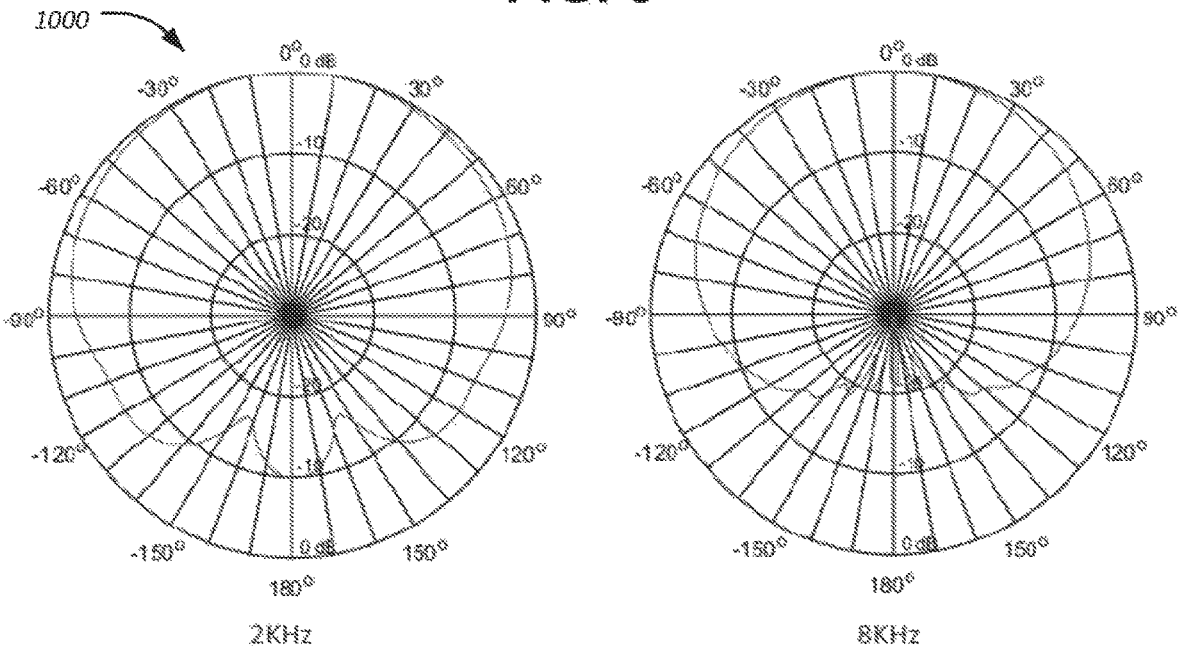
FIG. 10 illustrates example computed polar responses of a cylindrical enclosure of an example variable acoustics loudspeaker.

FIG. 10 illustrates example computed polar responses 1000 of a cylindrical enclosure of an example variable acoustics loudspeaker 102. More specifically, FIG. 10 shows resulting responses for a transducer of radius π/12 and a cylinder of radius α=0.084m at f=2 KHz and f=8 KHz, respectively. It can be seen that, in the illustrated example, sufficient rear attenuation (for instance 20 dB) to support beamforming can only be achieved at very high frequencies. At lower frequencies, an array of transducers needs to be employed with optimal beamforming filters, which is the scope of this disclosure.

As an example, four beam patterns $at_1$-$at_4$ may be defined as follows:

$$\begin{aligned} at_1 &= [\,0\ \ -2.5\ \ -6\ \ -10\ \ -15\ \ -20\ \ -25\ \ -25\ \ -25\,] \\ at_2 &= [\,0\ \ 0\ \ -1.5\ \ -3\ \ -5\ \ -10\ \ -15\ \ -25\ \ -25\,] \\ at_3 &= [\,0\ \ 0\ \ 0\ \ 0\ \ -3\ \ -6\ \ -10\ \ -15\ \ -20\,] \\ at_4 &= [\,0\ \ 0\ \ 0\ \ 0\ \ 0\ \ 0\ \ -3\ \ -6\ \ -8\,] \end{aligned} \tag{13}$$

specifying attenuation in decibels at discrete angles $\alpha_k$=[0 15 39 45 60 90 120 150 180] degrees, k=1-9. The patterns can be interpreted as "spatial filters", with coverage angles 60°; 120°; 180°; 240°, respectively as illustrated in FIGS. 11-12.

Figure 11:
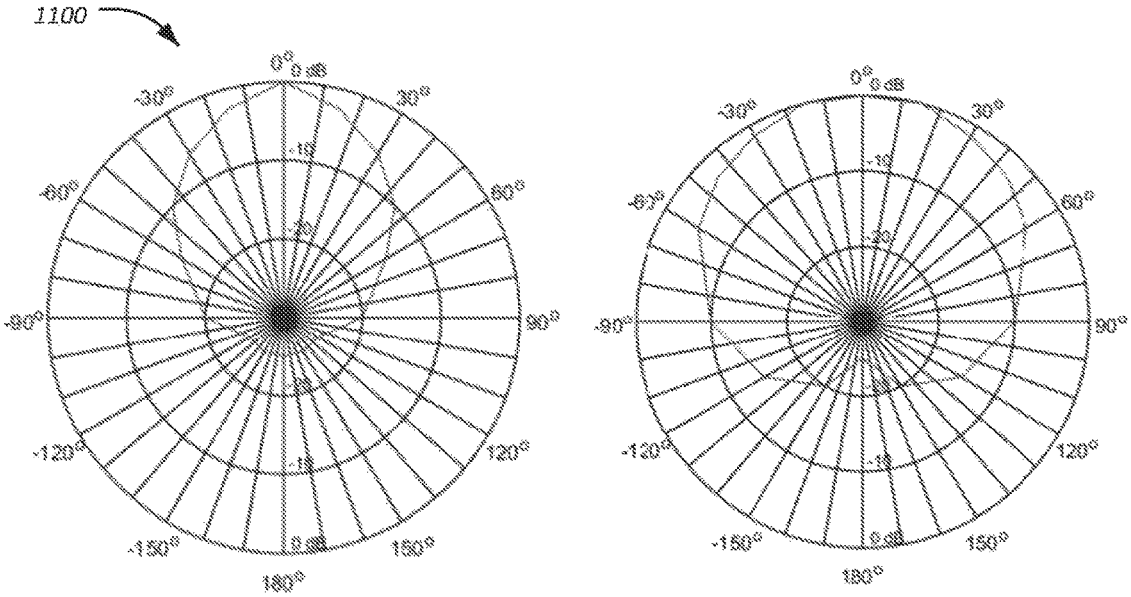
FIG. 11 illustrates example prescribed spatial filters for 60° and 120° coverage for an example variable acoustics loudspeaker.
Figure 12:
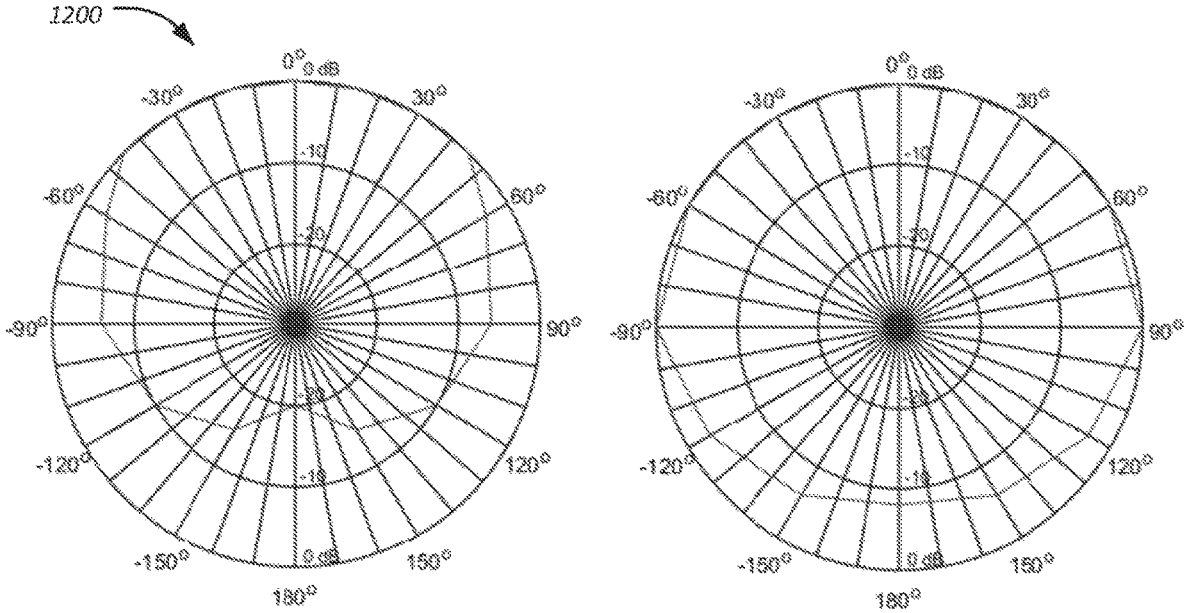
FIG. 12 illustrates example prescribed spatial filters for 180° and 240° coverage for an example variable acoustics loudspeaker.

FIG. 11 illustrates example prescribed spatial filters 1100 for 60° and 120° coverage for an example variable acoustics loudspeaker 102. FIG. 12 illustrates example prescribed spatial filters 1200 for 180° and 240° coverage for an example variable acoustics loudspeaker 102.

Figure 13:
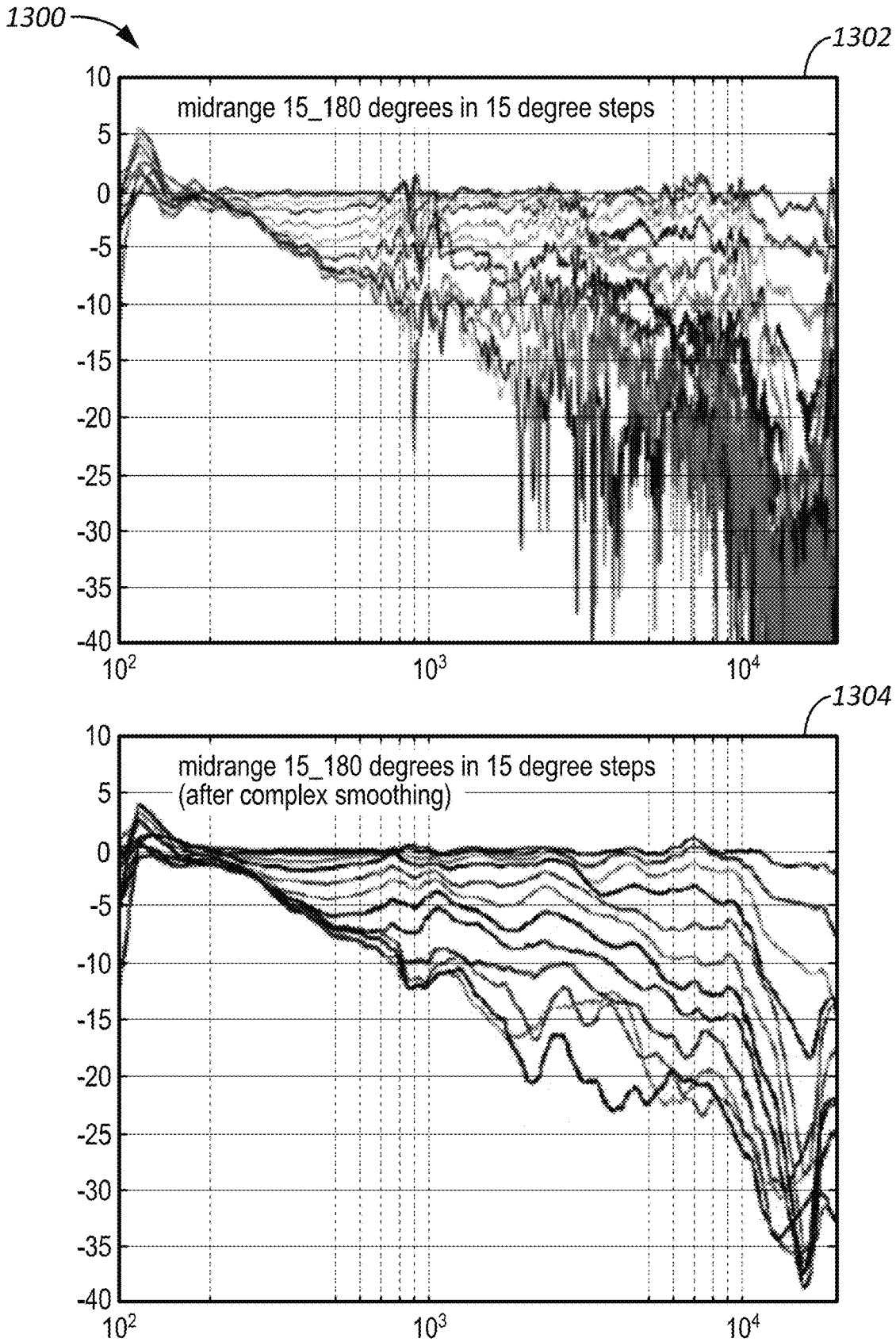
FIG. 13 illustrates example measured midrange frequency responses under various horizontal angles, both raw and smoothed.

FIG. 13 illustrates example measured midrange frequency responses 1300 under various horizontal angles, both raw and smoothed. The disclosed beamforming filter design is based on data captured by acoustic measurements in an anechoic chamber. The trace 1302 shows a set of measurements for one of the six midrange transducer pairs of the VAL 102A of FIG. 1, at angles (15 . . . 180°) in 15° steps. The lower and upper transducers are pair-wise connected. The results are obtained by measuring one transducer pair and rotating the loudspeaker on a software-controlled turntable.

The data shows strong fluctuations due to reflections on the surface of the cylinder, in particular, at angles at the opposite (shadowed) side of the sound source >120°. The reflections are caused by neighboring transducers that act as secondary sources on the surface, causing acoustic diffraction. In order to prepare the data for further processing, a smoothing algorithm is applied, which smooths the data while preserving phase information. Starting with a discrete, complex frequency response $H(\omega_k)$, k=1 . . . N, magnitude |H| and unwrapped phase φ=arg[H] is computed, and then each magnitude and phase value is replaced by its mean over a window of variable length:

$$|H_{sm}(\omega_k)| = \frac{1}{m_1+m_2-1}\sum_{l=m_1}^{m_2} |H(\omega_l|; \tag{14}$$

$$\varphi_{sm}(\omega_k) = \frac{1}{m_1+m_2-1}\sum_{l=m_1}^{m_2} \varphi(\omega_k)$$

with:

$$m_1(k) = \begin{cases} \lfloor k/s \rfloor \\ 1, \frac{k}{s} < 1 \end{cases}, m_2(k) = \begin{cases} \lfloor k\ s \rfloor \\ N, k\ s > N \end{cases} \quad (15)$$

with block length N=2048, and s=(1.01 . . . 1.20) a factor depending on the desired amount of smoothing (typically s=1.1);

The smoothed frequency response can be reconstructed as $H_{sm}=|H_{sm}|e^{-j\varphi sm}$.

The trace 1304 shows a plot of the magnitude after smoothing.

Figure 14:
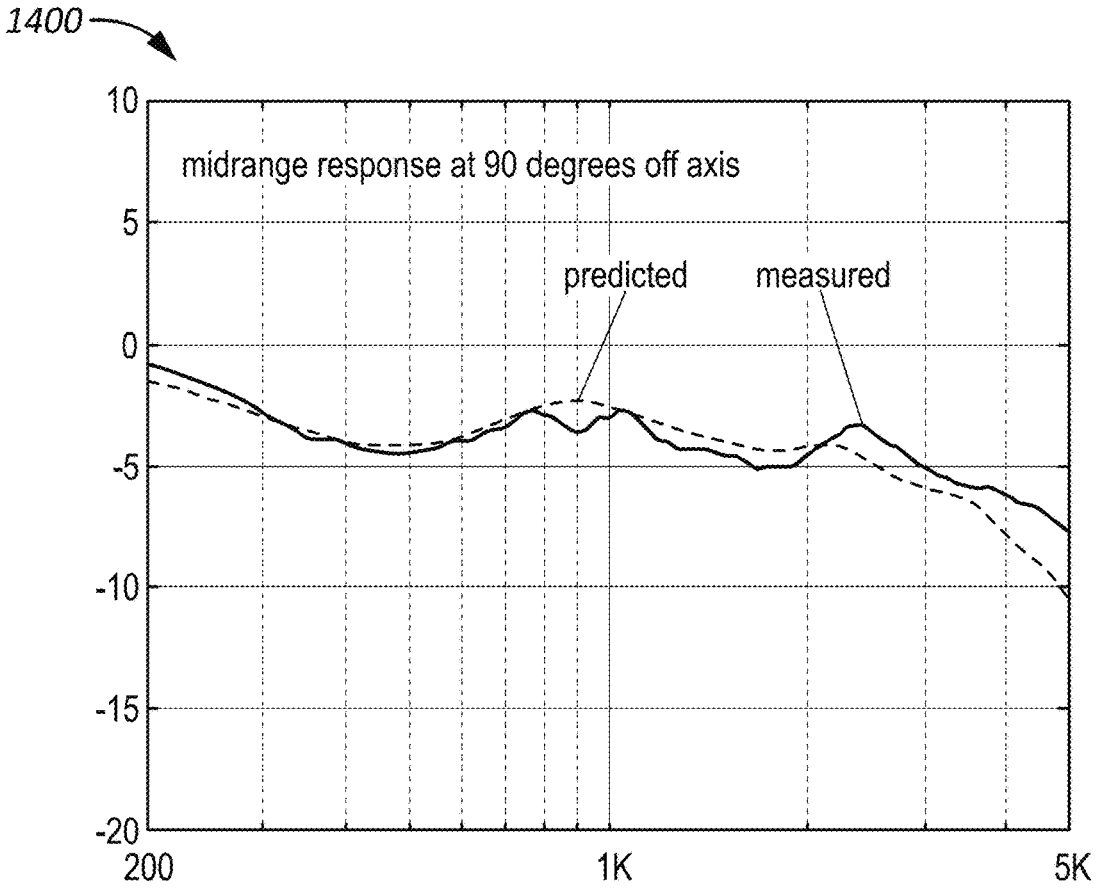
FIG. 14 illustrates an example comparison of modeled and measured midrange frequency responses for an example variable acoustics loudspeaker.

FIG. 14 illustrates an example comparison 1400 of modeled and measured midrange frequency responses for an example variable acoustics loudspeaker. Accordingly, it can be seen that there is a good match between smoothed, measured, and, according to equation (12), predicted responses.

The beam filters are designed iteratively, as outlined in the following section.

Figure 15:
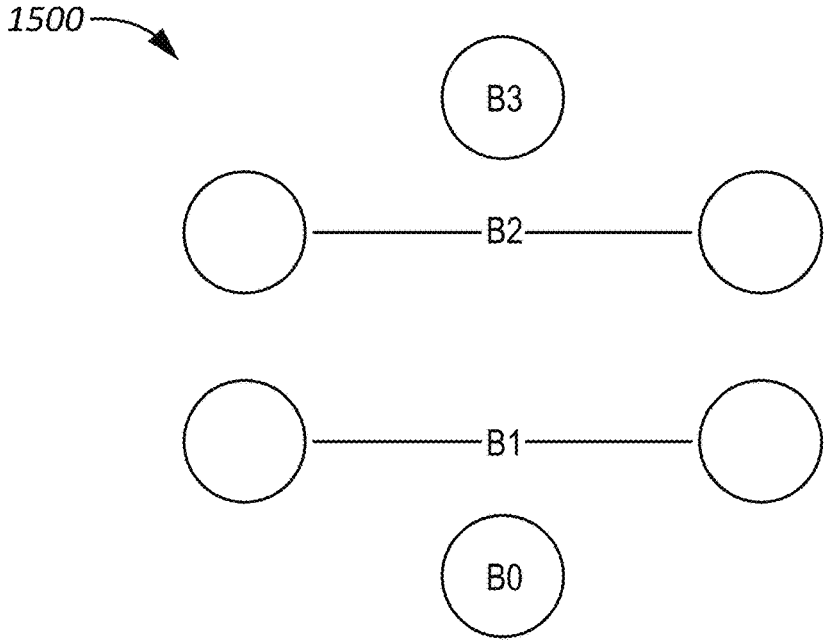
FIG. 15 illustrates an example midrange driver layout with filters B0-B3 for an example variable acoustics loudspeaker.

FIG. 15 illustrates an example midrange driver layout 1500 with filters B0-B3 for an example variable acoustics loudspeaker. In the midrange driver layout 1500, one front driver is connected to a filter B0, a pair of drivers at +/−600 are both fed by a filter B1, another pair of drivers at +/−120° are connected to B2, and a rear driver is connected to B3.

The following general procedure may apply to any symmetric driver layout with at least four drivers. Any number of driver pairs can be added to increase spatial resolution.

The measured, smoothed complex frequency responses (14) can be written in matrix form:

$$H_{sm}(i,j),\ i=1\ .\ .\ .\ N,\ j=1\ .\ .\ .\ M \quad (16)$$

The frequency index is i, N is the FFT length, and M the number of angular measurements in the interval [0 . . . 180]°. In practice, N=512 for tweeters and N=2048 for midranges; M=13 in case 15° steps are chosen.

An array of R drivers (where R is an even number) comprises one frontal driver at 0°, one rear driver at 180°, and P=(R−2)/2 driver pairs located at the angles $$\alpha_r = r\frac{180°}{P+1},$$

r=1, . . . , P. Goal is the design of P beamforming filters $C_r$ to be connected to the driver pairs, and an additional filter $C_{P+1}$ for the rear driver.

First, the measured frequency responses are normalized at angles greater than zero with respect to the frontal response to eliminate the driver frequency response. This normalization will be factored back in later when designing the final filter in form of driver equalization.

$$H_0(i)=H_{sm}(i,1);$$

$$H_{norm}(i,j)=H_{sm}(i,j)/H_0(i),\ i=1\ .\ .\ .\ N,\ j=1\ .\ .\ .\ M \quad (17)$$

The following filter design iteration works for each frequency point separately. The frequency index may be eliminated for convenience to define:

$$H(\alpha_k):=H_{norm}(i,k) \quad (17\text{-}1)$$

as the measured and normalized frequency response at discrete angle $a_k$.

Assuming a radial-symmetric, cylindrical enclosure, and identical drivers, the frequency responses U(k) of the array can be computed at angles $a_k$ by applying the same offset angle to all drivers:

$$U(k) = H(\alpha_k) + \sum_{r=1}^{P} C_r \cdot \{H(\langle\alpha_k + \alpha_r\rangle) + H(\langle\alpha_k - \alpha_r\rangle)\} + C_{P+1} \cdot H(\langle\alpha_k + 180°\rangle), \quad (18)$$

$$\langle\alpha\rangle := \begin{cases} |\alpha|, -180° < \alpha < 180° \\ 360° - \alpha, \alpha > 180° \end{cases}.$$

The spectral filter values $C_r$ can be obtained iteratively by minimizing the quadratic error function:

$$e=\sqrt{\Sigma_{k=1}^{Q} w(k)(|U(k)/a|-t(k))^2}. \quad (19)$$

t(k) may be one of the target functions (13) to specify beam shape or coverage, for example $t(k)=10^{at_1(k)/20}$. Instead, other target functions may be chosen or different target functions for different frequency bands, in which case t becomes frequency dependent t=t(i,k).

The parameter a in (19) is an input parameter to be chosen. It specifies the array gain as follows:

$$a\text{gain}=20\cdot\log(a) \quad (20)$$

This is one of the target conditions for the design. The array gain specifies how much louder the array plays compared to one single transducer. It should be higher than one, but cannot be higher than the total transducer number R. In order to allow some sound cancellation that is necessary for super-directive beamforming, the array gain will be less than R but should be much higher than one.

Q is the number of angular target points (for example Q=9 in equation (13)).

w(k) is a weighting function that can be used if higher precision is required in a particular approximation point versus another (usually 0.1<w<1).

The variables to be optimized are the P+1 complex filter values per frequency index, i, $C_r(i)$, r=1 . . . (P+1). We start at the first frequency point in the band of interest $$i = i_1 = \left\lfloor \frac{f_1}{f_g} \cdot N \right\rfloor$$

for example $f_1$=300 Hz, $f_g$=24 KHz, N=2048=>$i_1$=25), set $C_r=1\forall r$ as start solution, then subsequently compute the filter values by incrementing the index each time until we reach the last point $$i = i_2 = \left\lceil \frac{f_2}{f_g} \cdot N \right\rceil$$

(e.g. $f_2$=3 KHz=>$i_2$=256).

Instead of real and imaginary part, magnitude $|C_r(i)|$ and phase $\arg(C_r(i))=\arctan(i\{C_r(i)\}/\mathrm{Re}\{C_r(i)\})$ can be used for the nonlinear optimization routine as variables.

This bounded, nonlinear optimization problem can be solved with standard software, for example the function "fmincon", which is part of the Matlab optimization toolbox. The following bounds can be applied:

$$G_{max}=20*\log(\max(|C_r|)) \quad (21)$$

as the maximum allowed filter gain, and lower and upper limits for the magnitude values from one calculated frequency point to the next to be calculated point, specified by an input parameter δ:

$$|C_r(i)|\cdot(1-\delta<|C_r(i+1)|<|C_r(i)|\cdot(1+\delta) \quad (22)$$

in order to control smoothness of the resulting frequency response.

Figure 16:
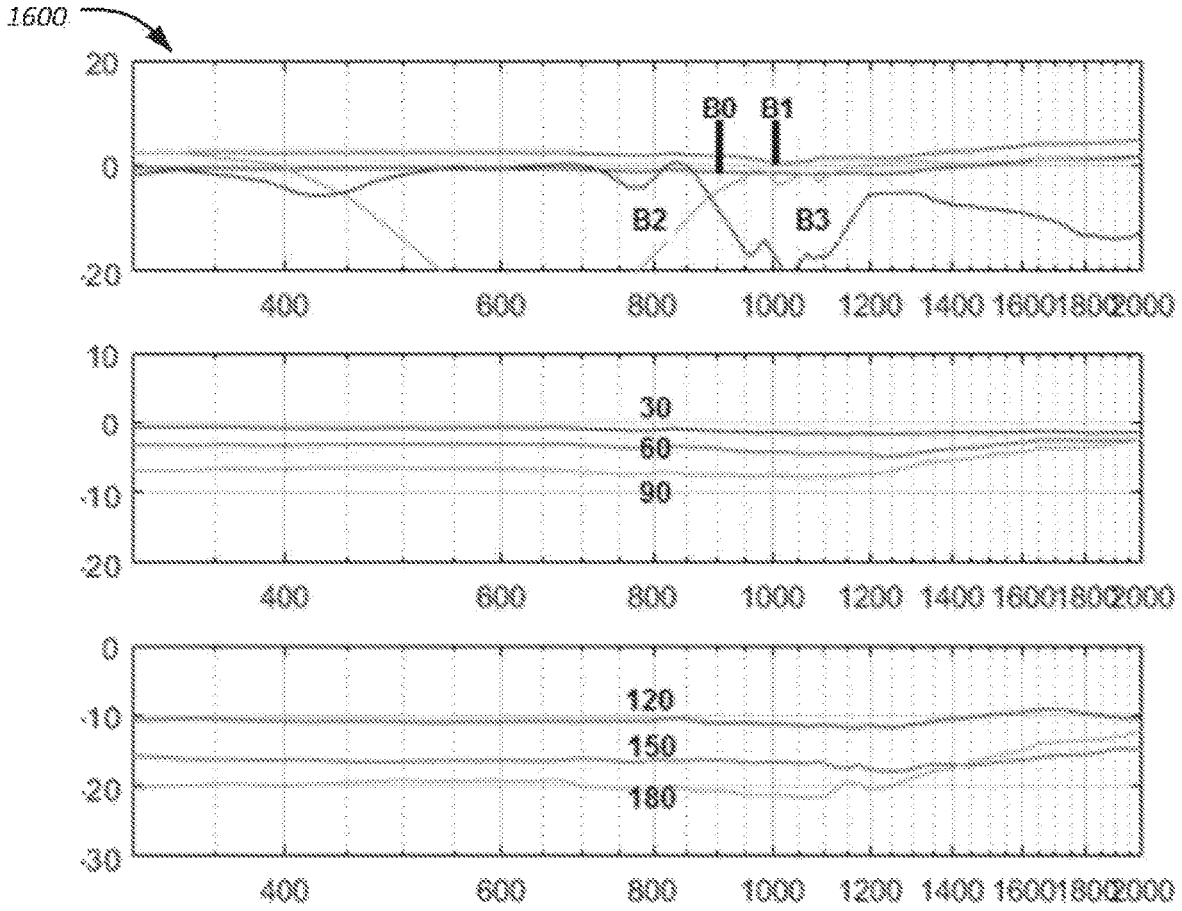
FIG. 16 illustrates example 180° coverage midrange filter frequency responses as well as resulting horizontal off-axis acoustic responses for an example variable acoustics loudspeaker.
Figure 17:
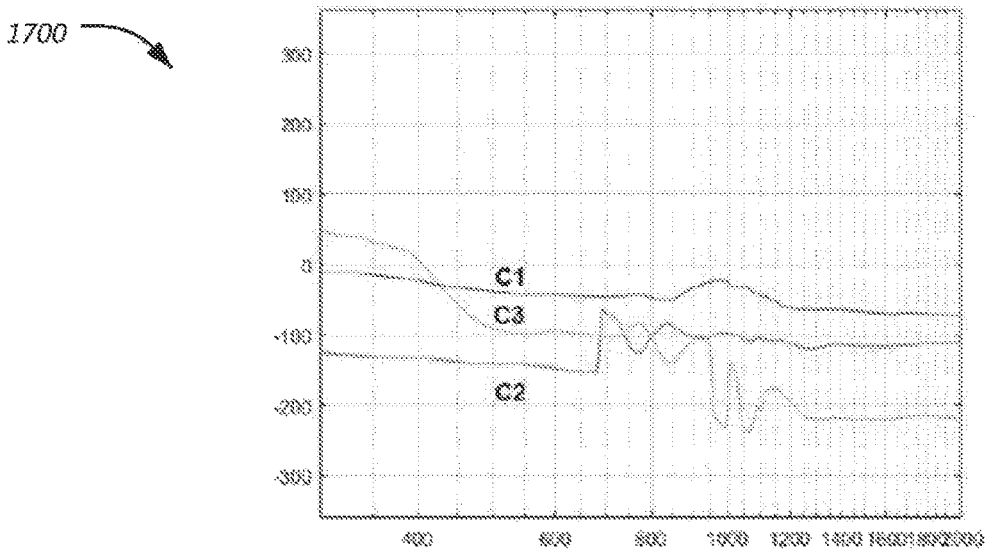
FIG. 17 illustrates example phase responses of normalized beamforming filters for midrange 180° beaming for an example variable acoustics loudspeaker.
Figure 18:
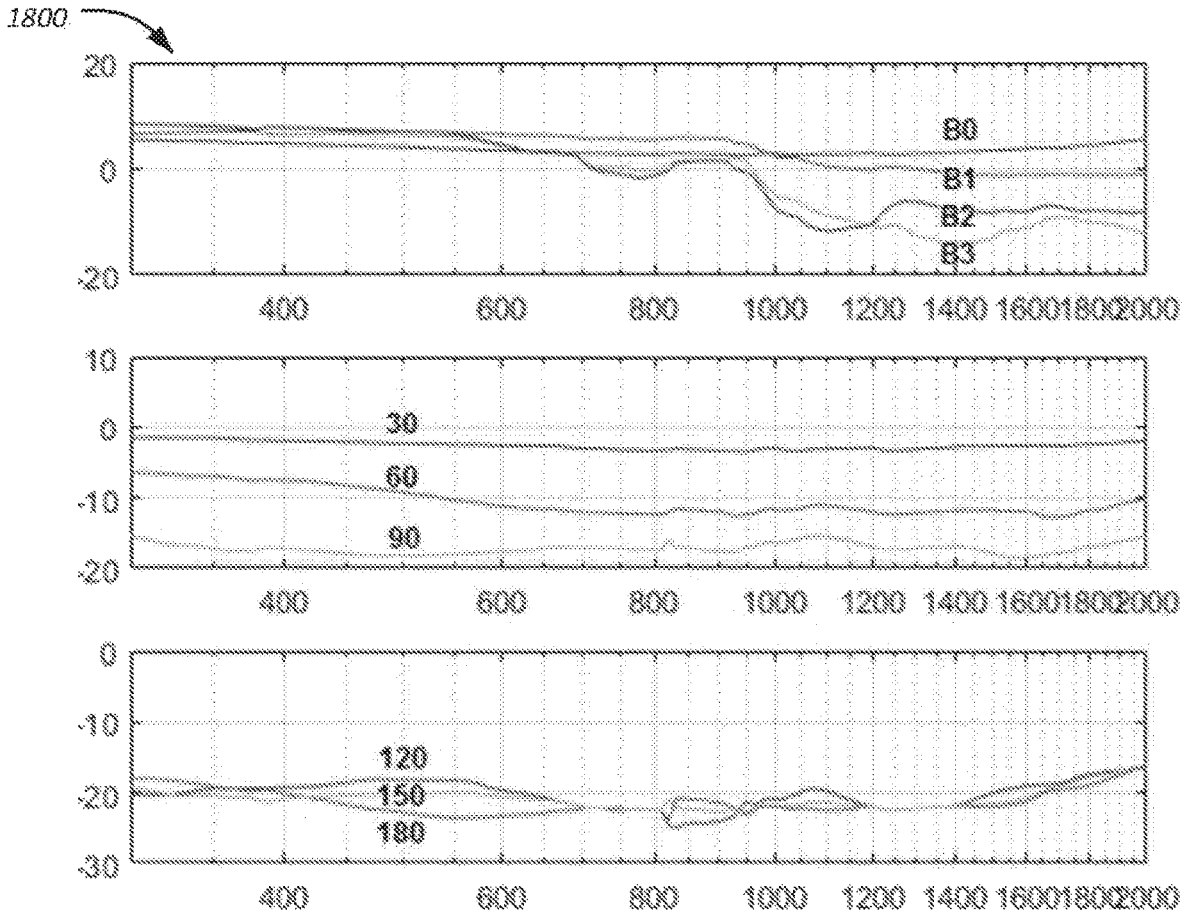
FIG. 18 illustrates example 60° coverage midrange filter frequency responses as well as resulting horizontal off-axis acoustic responses for an example variable acoustics loudspeaker.

In a midrange example, FIGS. 16-18 show results for the midrange drivers of the example of FIG. 1. The parameters for the midrange example are:

| | |
|---|---|
| Beam pattern, (see equation 13) | $at_3$ (FIGS. 16-17); $at_1$ (FIGS. 18-19) |
| Number of drivers | R = 8 |
| Number of driver pairs | P = 3 |
| Calculated beamforming filters | $C_1$, $C_2$, $C_3$ (per side consecutively) |
| Array gain (see equation 20) | again = 10 dB |
| Max. filter gain (see equation 21) | $G_{max}$ = 3 dB |
| Smoothing bound (see equation 22) | δ = 0.2 (FIGS. 16-17); δ = 2 (FIGS. 18-19) |

The filters $B_1 \ldots B_3$ in the FIGS are the beamforming filters, but normalized to the on-axis response $B_0$:

$$B_0 = U(0)\ (\alpha_k = 0° \text{ in equ. } 18) \quad (23)$$

$$B_1 = \frac{C_1}{B_0};\ B_2 = \frac{C_2}{B_0};\ B_3 = \frac{C_3}{B_0}.$$

FIG. 16 illustrates example 1600 of 180° coverage midrange frequency responses as well as resulting horizontal off-axis acoustic responses for an example variable acoustics loudspeaker 102. As indicated in the example 1600, very smooth off-axis responses can be realized.

FIG. 17 illustrates example 1700 of a phase response of normalized beamforming filters for midrange 180° beaming for an example variable acoustics loudspeaker 102. FIG. 18 illustrates an example 1800 of a 60° coverage midrange frequency responses as well as resulting horizontal off-axis acoustic responses for an example variable acoustics loudspeaker 102. The examples 1900 document a typical, widely frequency-independent phase offset between the beamforming filters. The narrow beam in the example 1800 confirms that a rear attenuation of about 20 dB is achieved, without apparent side lobes.

Figure 19:
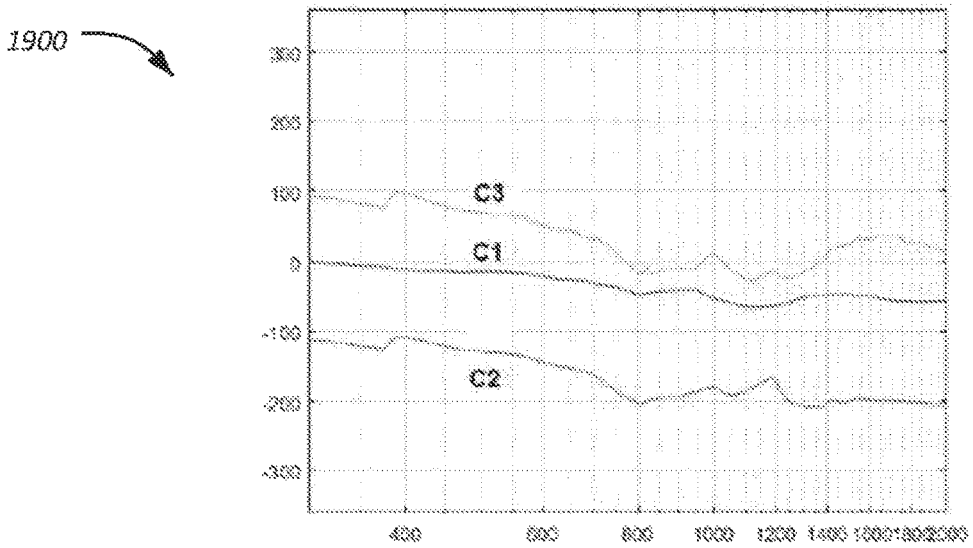
FIG. 19 illustrates example phase responses of normalized beamforming filters for midrange 60° beaming for an example variable acoustics loudspeaker.

FIG. 19 illustrates example phase responses 1900 of normalized beamforming filters for midrange 60° beaming for an example variable acoustics loudspeaker 102.

Figure 20:
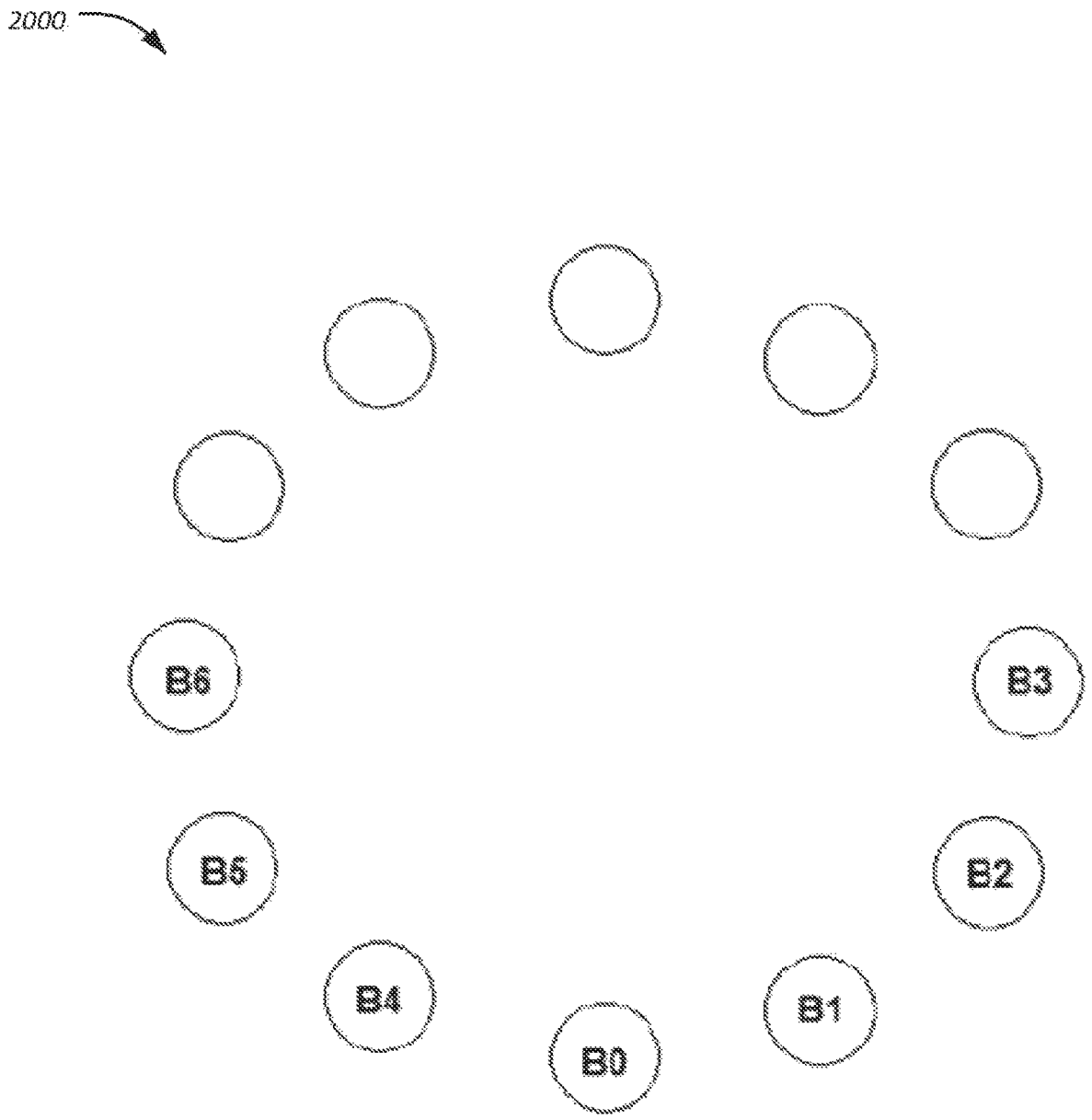
FIG. 20 illustrates an example tweeter driver layout with filters B0-B6 for an example variable acoustics loudspeaker.

FIG. 20 illustrates an example 2000 tweeter driver layout with filters B0-B6 for an example variable acoustics loudspeaker 102. There are two deviations from the previously outlined general procedure. First, the system is only using the frontal seven out of total twelve tweeters. The rear tweeters are only used for beam rotation purposes (see FIG. 3). Second, separate filters are calculated for the right side ($B_1 \ldots B_3$), versus the left side ($B_4 \ldots B_6$).

Figure 21:
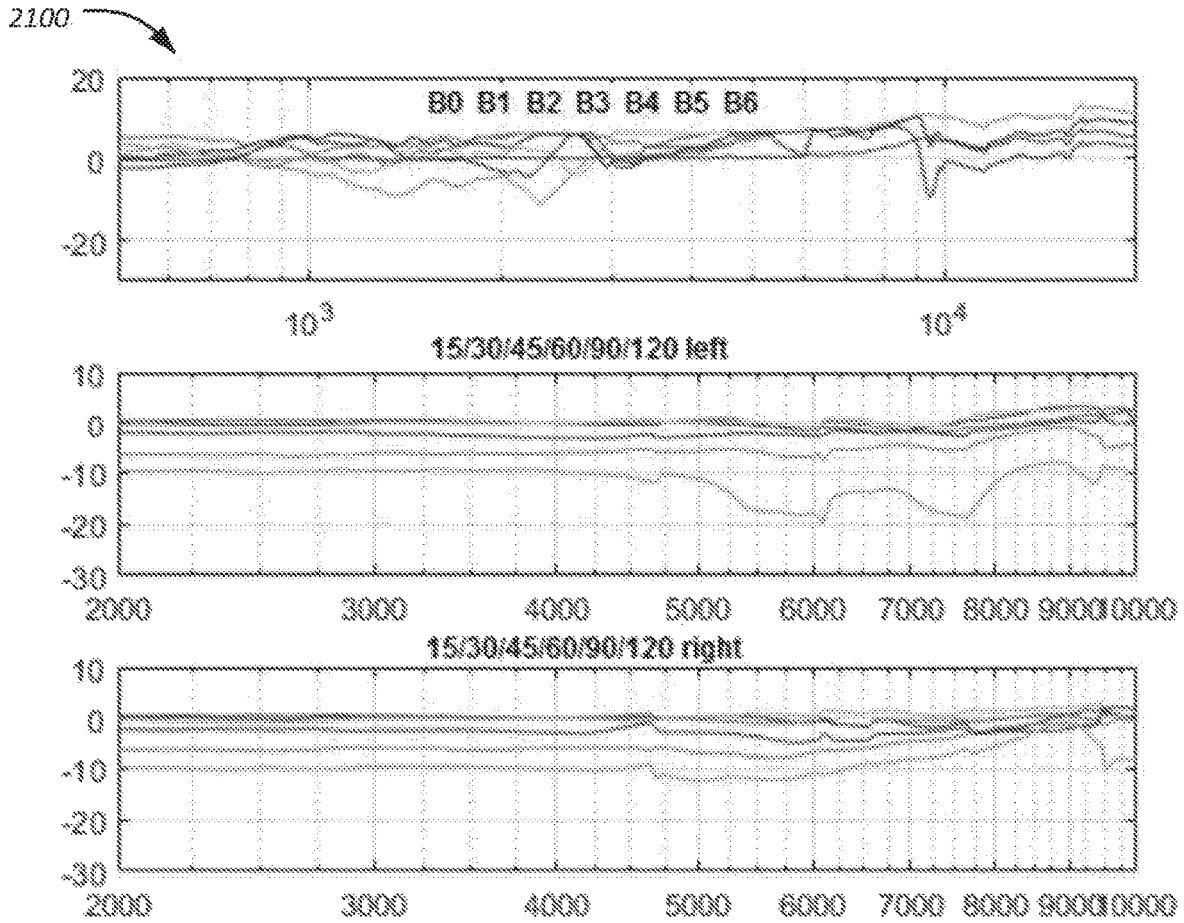
FIG. 21 illustrates example 180° coverage tweeter frequency responses as well as resulting horizontal off-axis acoustic responses for an example variable acoustics loudspeaker.
Figure 22:
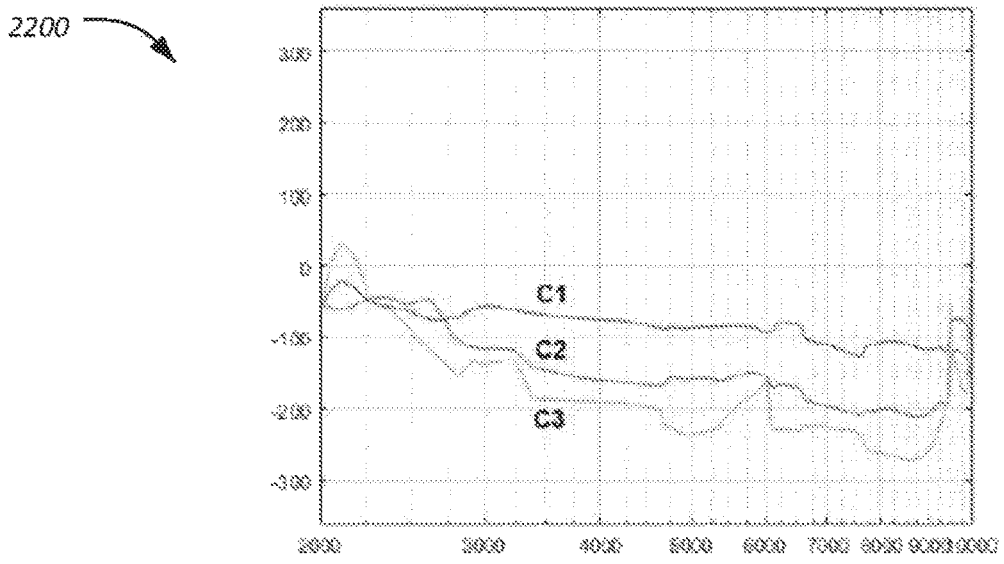
FIG. 22 illustrates example phase responses of normalized beamforming filters for tweeter 180° beaming for an example variable acoustics loudspeaker
Figure 23:
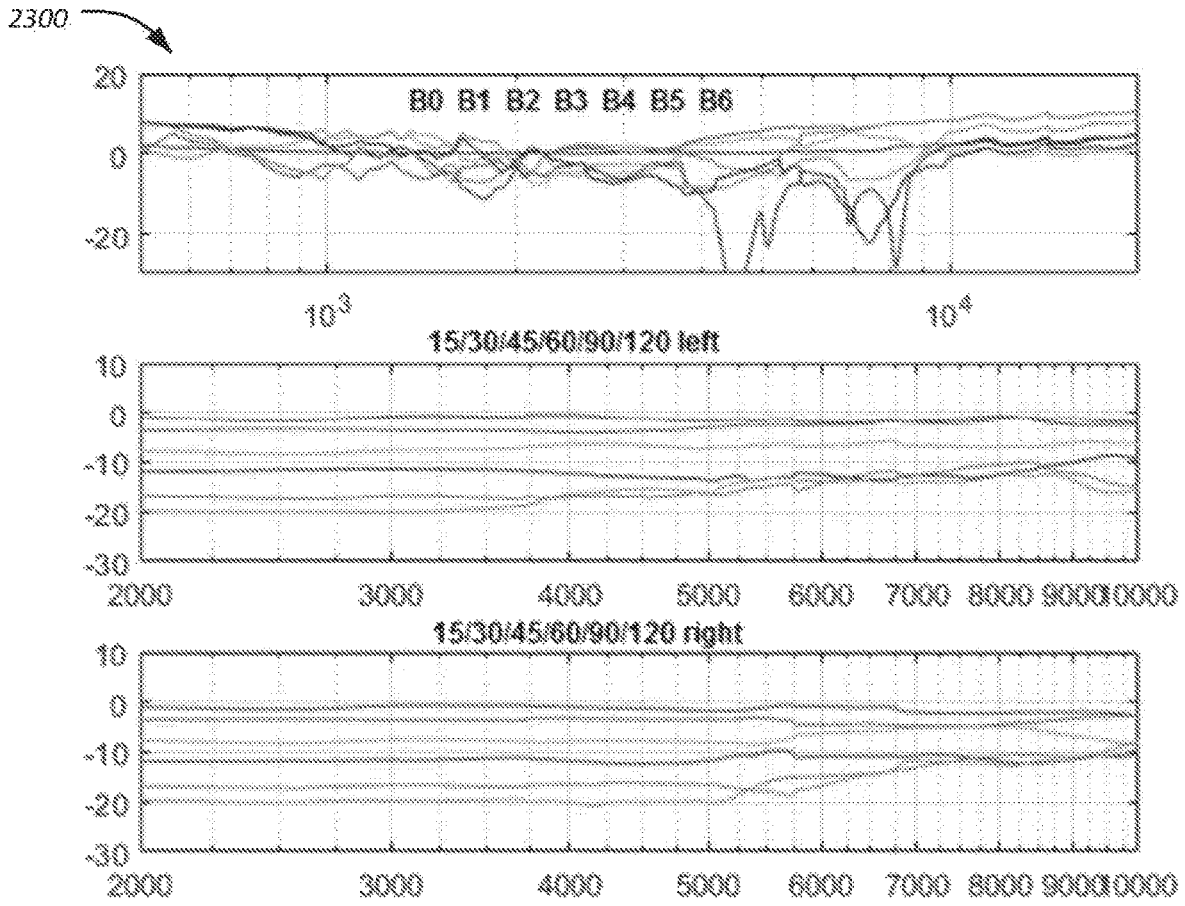
FIG. 23 illustrates example 60° coverage tweeter filter frequency responses as well as resulting horizontal off-axis acoustic responses for an example variable acoustics loudspeaker.
Figure 24:
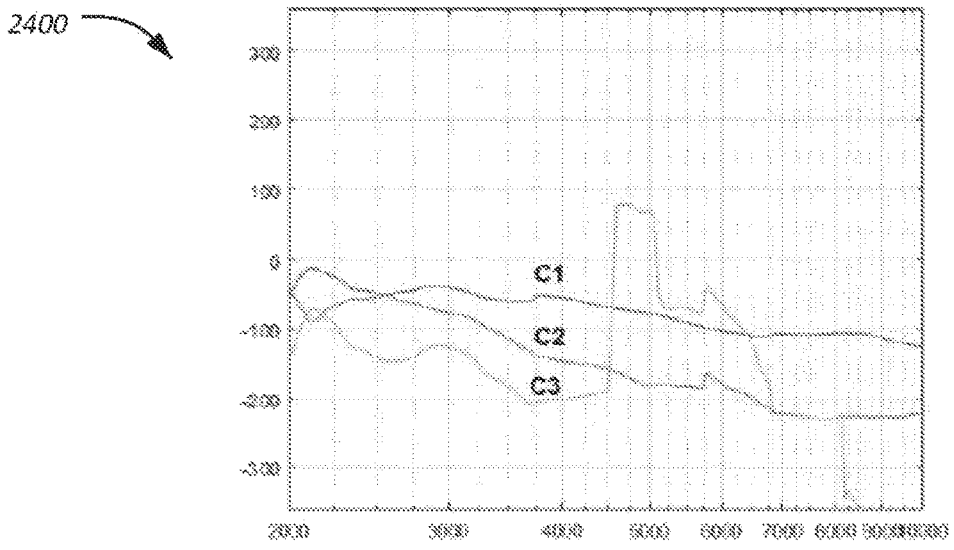
FIG. 24 illustrates example phase responses of normalized beamforming filters for tweeter 60° beaming for an example variable acoustics loudspeaker.

FIGS. 21-24 show the results. FIG. 21 illustrates example 180° coverage tweeter frequency responses as well as resulting horizontal off-axis acoustic responses for an example variable acoustics loudspeaker 102. FIG. 22 illustrates example phase responses 2200 of normalized beamforming filters for tweeter 180° beaming for an example variable acoustics loudspeaker 102. FIG. 23 illustrates example 60° coverage tweeter frequency responses 2300, as well as resulting horizontal off-axis acoustic responses for an example variable acoustics loudspeaker 102. FIG. 24 illustrates example phase responses 2400 of normalized beamforming filters for tweeter 60° beaming for an example variable acoustics loudspeaker 102. The parameters for the tweeter example are:

| | |
|---|---|
| Beam pattern, (see equation 13) | $at_3$ (FIGS. 21-22); $at_1$ (FIGS. 23-24) |
| Number of drivers | R = 12 |
| Number of driver pairs | P = 3 |
| Calculated beamforming filters | $C_1$, $C_2$, $C_3$ (per side consecutively) |
| Array gain (see equation 20) | again = 12 dB |
| Max. filter gain (see equation 21) | $G_{max}$ = 6 dB |
| Smoothing bound (see equation 22) | δ = 0.2 (FIGS. 21-22); δ = 2 (FIGS. 23-24) |

The graph again shows that a very smooth, controlled directivity can be achieved throughout the entire audible frequency range.

Regarding system integration and results, crossover filter, beamforming filter and driver equalization can be combined into one filter Fr:

$$F_r = \frac{H_c B_r}{H_0} \quad (24)$$

where:

$B_r$ is a beamforming filter normalized according to equation (23);

$H_c$ is one of the crossover filters of FIG. 3 and FIG. 4 (see equation 5); and $H_0$ is the acoustic frequency response of the driver.

The advantage of integrating the crossover filter is its band-limiting property. The combined filter becomes more stable (the impulse responses converge quicker to zero), thereby reducing overall filter lengths and complexity.

Figure 25:
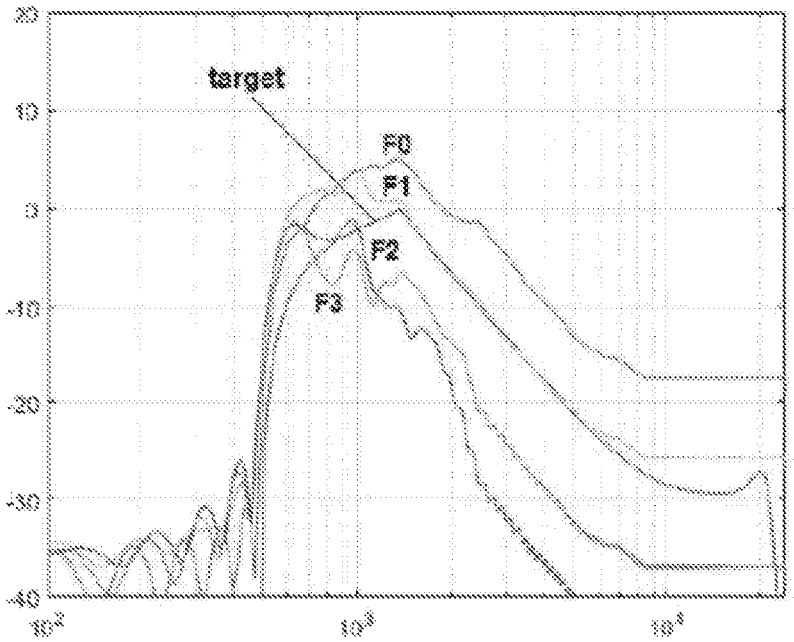
FIG. 25 illustrates example combined midrange filter responses including beamforming, equalization, and crossover for an example variable acoustics loudspeaker.
Figure 26:
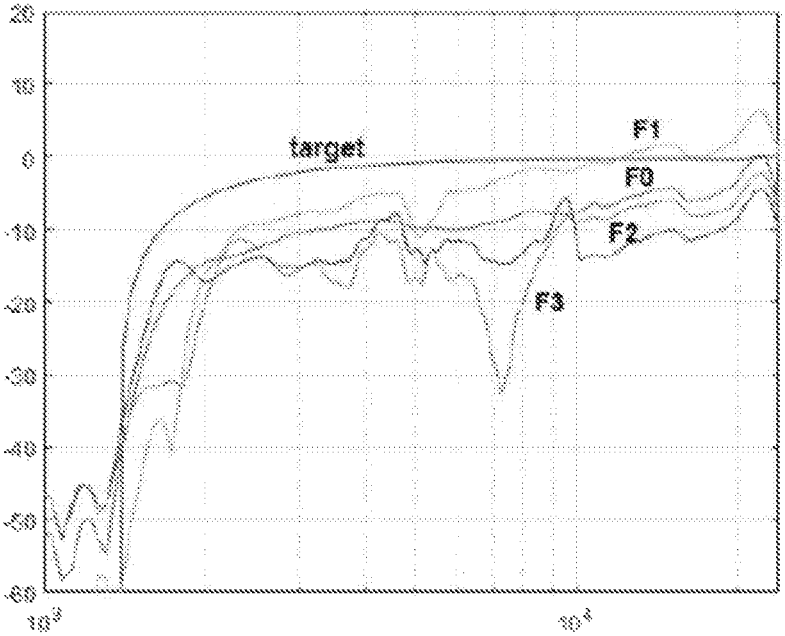
FIG. 26 illustrates example combined tweeter responses including beamforming, equalization, and crossover for an example variable acoustics loudspeaker.

FIG. 25 illustrates example combined midrange filter responses 2500 including beamforming, equalization, and crossover for an example variable acoustics loudspeaker 102. FIG. 26 illustrates example combined tweeter responses 2600 including beamforming, equalization, and crossover for an example variable acoustics loudspeaker 102.

Figure 27:
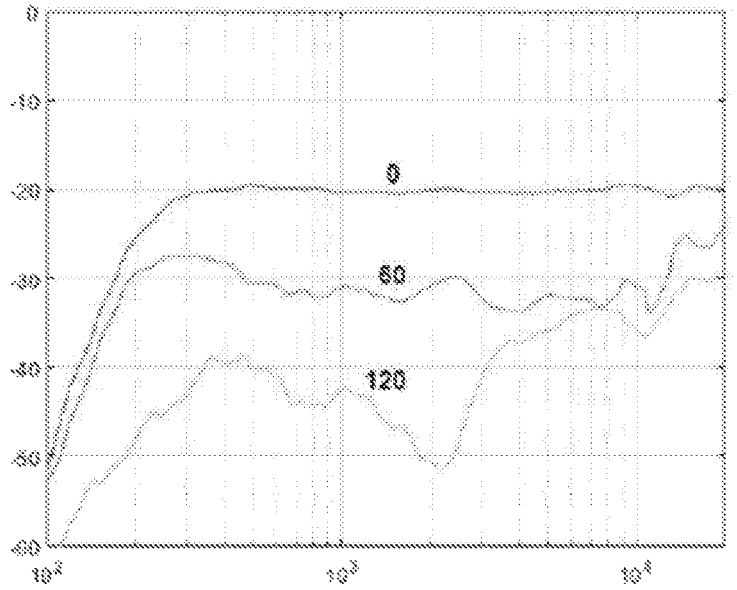
FIG. 27 illustrates example combined system acoustic responses for an example variable acoustics loudspeaker.

FIG. 27 shows combined acoustic responses 2700 for the example variable acoustic loudspeaker of FIG. 1 at 0°, 60°, and 120° horizontally off-axis.

Figure 28:
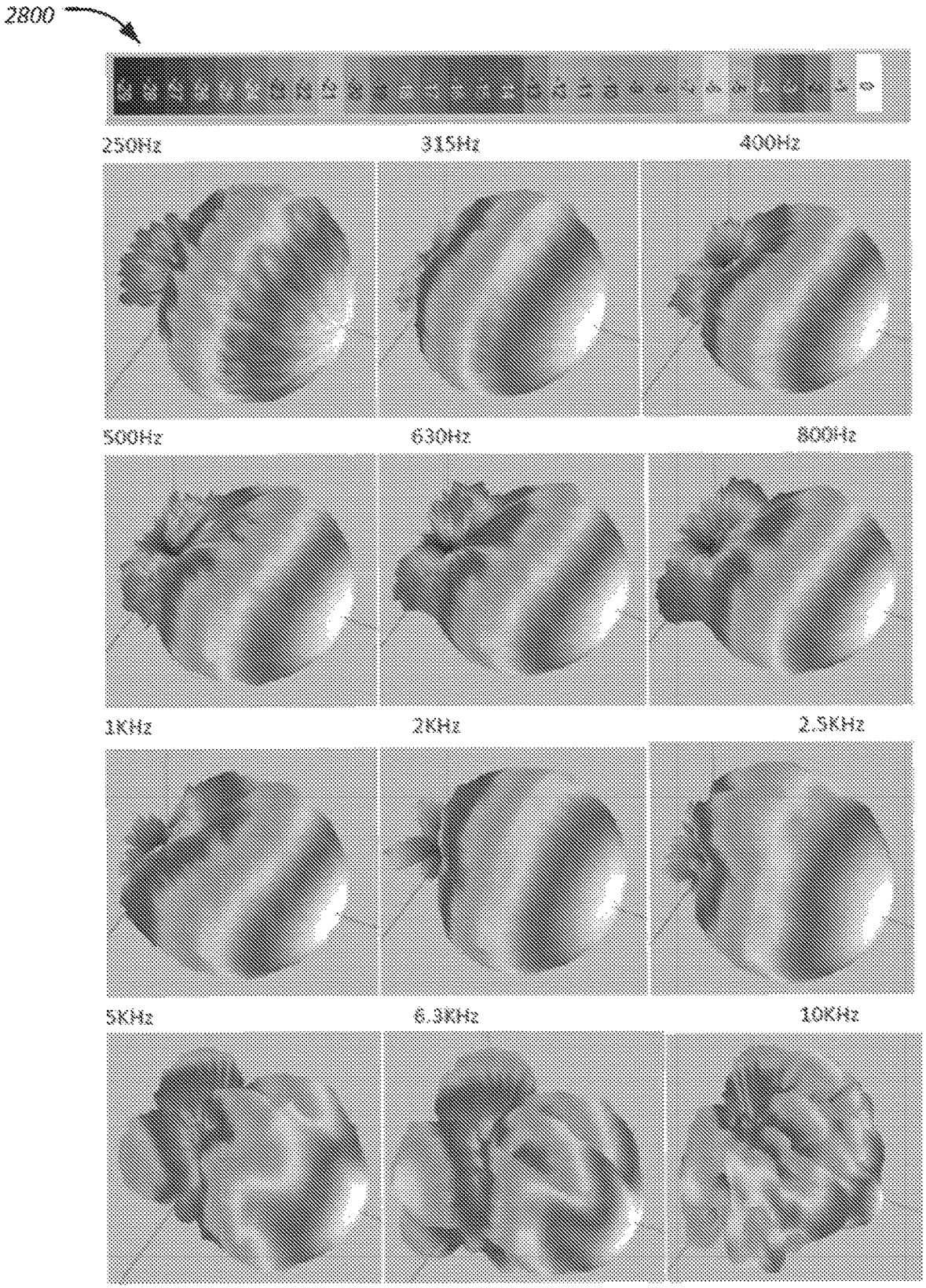
FIG. 28 illustrates example 3D system radiation plots for narrow beam+/−30° for an example variable acoustics loudspeaker.
Figure 29:
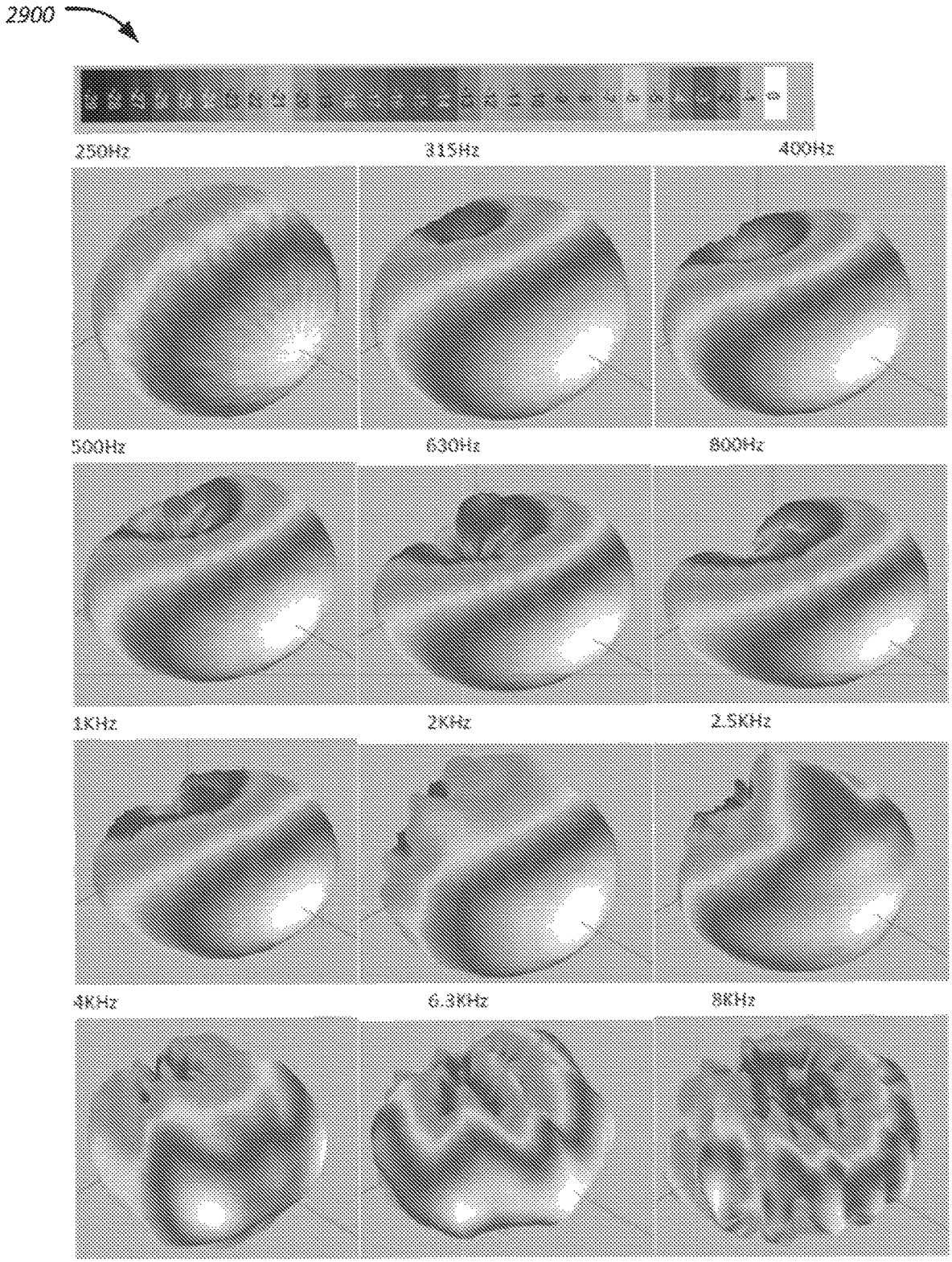
FIG. 29 illustrates example 3D system radiation plots for wide beam+/−60° for an example variable acoustics loudspeaker.

FIG. 28 and FIG. 29 display a series of full sphere acoustic measurements 2800, 2900 for the example variable acoustic loudspeaker of FIG. 1 for a narrow beam with +/−300 coverage ($at_1$ in 13), and a wider beam with +/−600 coverage ($at_3$).

Figure 30:
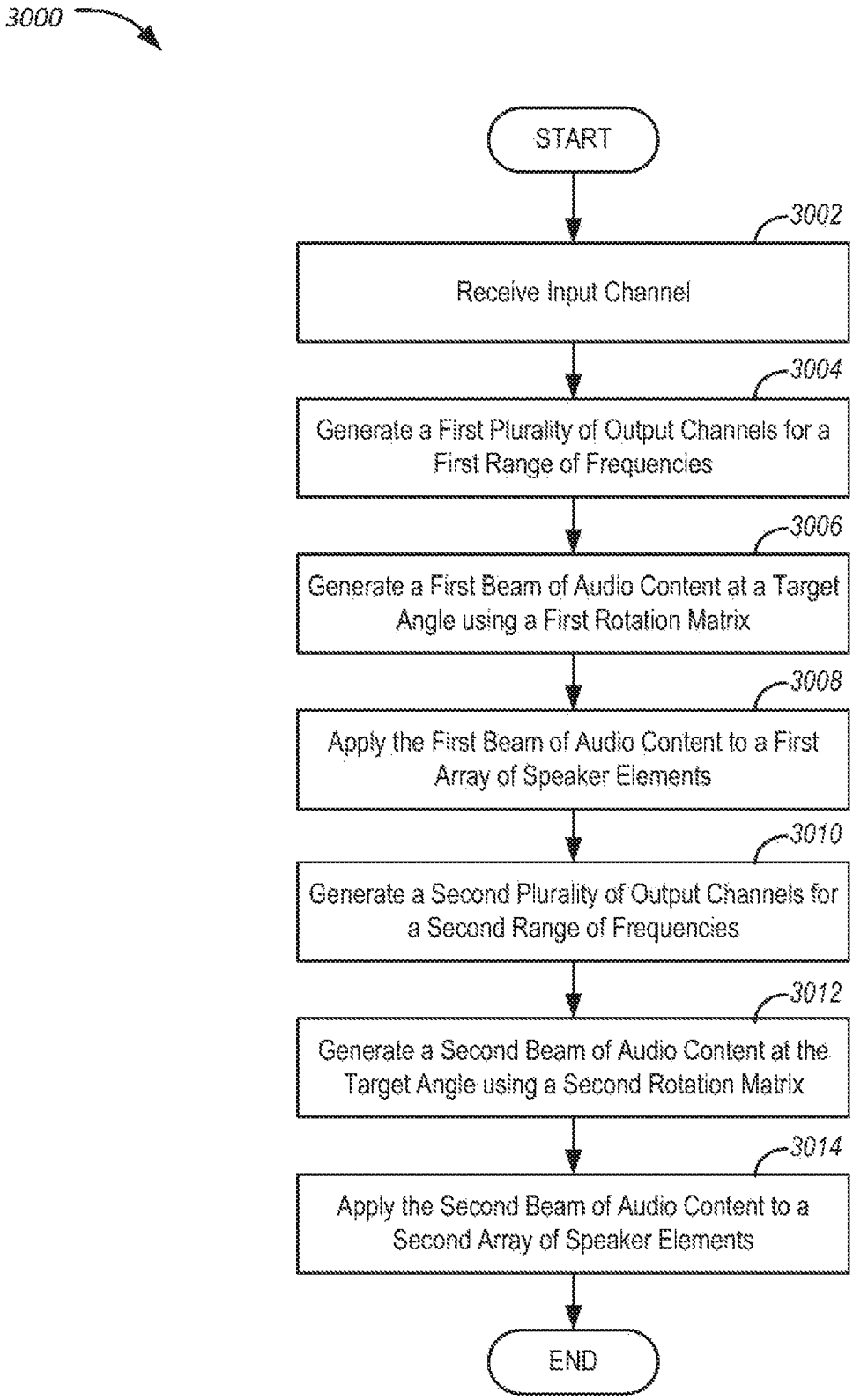
FIG. 30 illustrates an example process for beamforming for an example variable acoustics loudspeaker.

FIG. 30 illustrates an example process 3000 for beamforming for an example variable acoustics loudspeaker 102. In an example, the process may be performed by the variable acoustics loudspeaker 102 using the concepts discussed in detail above. At 3002, the variable acoustics loudspeaker 102 receives an input channel. In an example, the input may be provided to the variable acoustics loudspeaker 102 to be processed by the digital signal processor. In some examples, the input may include a mono channel, while in some examples stereo channel or more channels may be provided to the variable acoustics loudspeaker 102.

At operation 3004, the variable acoustics loudspeaker 102 generates a first plurality of output channels for a first range of frequencies. In an example, as discussed at least with respect to FIGS. 3 and 3B, a set of finite input response filters may be used by the digital signal processor to generate a plurality of output channels to be used for high-frequency beamforming. At 3006, the variable acoustics loudspeaker 102 generates a first beam of audio content at a target angle using a first rotation matrix. In an example, as discussed at least with respect to FIGS. 3, 3C, 3D, 3H, 3I, and 3J, outputs of the four high-frequency filters may be routed to twelve tweeter channels at a target angle. The variable acoustics loudspeaker 102 applies the first beam of audio content to a first array of speaker elements at 3008, e.g., as shown in FIG. 3. In an example, the first array of speaker elements are the drivers of the tweeter array 104 as shown in FIGS. 1 and 2.

At operation 3010, the variable acoustics loudspeaker 102 generates a second plurality of output channels for a second range of frequencies. In an example, as discussed at least with respect to FIGS. 3 and 3E, a set of finite input response filters may be used by the digital signal processor to generate a plurality of output channels to be used for mid-frequency beamforming. At 3012, the variable acoustics loudspeaker 102 generates a second beam of audio content at a target angle using a second rotation matrix. In an example, as discussed at least with respect to FIGS. 3, 3F, 3H, 3I, and 3J, outputs of the five mid-frequency filters may be routed to eight midrange channels at the target angle. The variable acoustics loudspeaker 102 applies the second beam of audio content to a second array of speaker elements at 3008, e.g., as shown in FIG. 3. In an example, the first array of speaker elements are the drivers of the midrange arrays 106 as shown in FIGS. 1 and 2.

Figure 31:
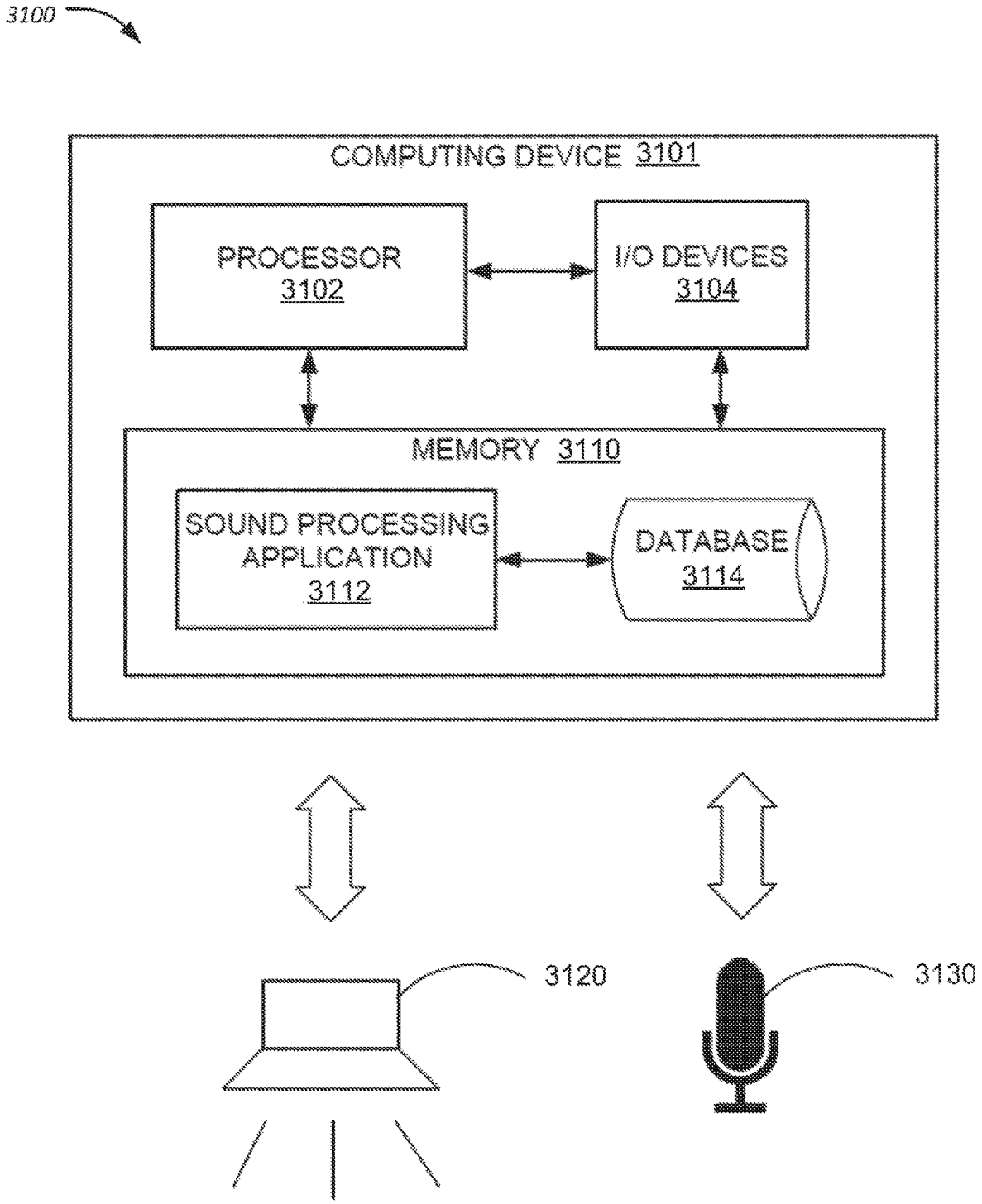
FIG. 31 is a conceptual block diagram of a computing system configured to implement one or more aspects of the various embodiments.

FIG. 31 is a conceptual block diagram of an audio system 3100 configured to implement one or more aspects of the various embodiments. As shown, the audio system 3100 includes a computing device 3101, one or more speakers 3120, and one or more microphones 3130. The computing device 3101 includes a processor 3102, input/output (I/O) devices 3104, and a memory 3110. The memory 3110 includes an audio processing application 3112 configured to interact with a database 3114.

The processor 3102 may be any technically feasible form of processing device configured to process data and/or execute program code. The processor 102 could include, for example, and without limitation, a system-on-chip (SoC), a central processing unit (CPU), a graphics processing unit (GPU), an application-specific integrated circuit (ASIC), a digital signal processor (DSP), a field-programmable gate array (FPGA), and so forth. Processor 3102 includes one or more processing cores. In operation, processor 3102 is the master processor of computing device 3101, controlling and coordinating operations of other system components.

I/O devices 3104 may include input devices, output devices, and devices capable of both receiving input and providing output. For example, and without limitation, I/O devices 3104 could include wired and/or wireless communication devices that send data to and/or receive data from the speaker(s) 3120, the microphone(s) 3130, remote databases, other audio devices, other computing devices, etc.

Memory 3110 may include a memory module or a collection of memory modules. The audio processing application 3112 within memory 3110 is executed by the processor 3102 to implement the overall functionality of the computing device 3101 and, thus, to coordinate the operation of the audio system 3100 as a whole. For example, and without limitation, data acquired via one or more microphones 3130 may be processed by the audio processing application 3112 to generate sound parameters and/or audio signals that are transmitted to one or more speakers 3120. The processing performed by the audio processing application 3112 may include, for example, and without limitation, filtering, statistical analysis, heuristic processing, acoustic processing, and/or other types of data processing and analysis.

The speaker(s) 3120 are configured to generate sound based on one or more audio signals received from the computing system 3000 and/or an audio device (e.g., a power amplifier) associated with the computing system 3000. The microphone(s) 3130 are configured to acquire acoustic data from the surrounding environment and transmit signals associated with the acoustic data to the computing device 3101. The acoustic data acquired by the microphone(s) 3130 could then be processed by the computing device 3101 to determine and/or filter the audio signals being reproduced by the speaker(s) 3120. In various embodiments, the microphone(s) 3130 may include any type of transducer capable of acquiring acoustic data including, for example and without limitation, a differential microphone, a piezoelectric microphone, an optical microphone, etc.

Generally, computing device 3101 is configured to coordinate the overall operation of the audio system 3000. In other embodiments, the computing device 3101 may be coupled to, but separate from, other components of the audio system 3000. In such embodiments, the audio system 3000 may include a separate processor that receives data acquired from the surrounding environment and transmits data to the computing device 3101, which may be included in a separate device, such as a personal computer, an audio-video receiver, a power amplifier, a smartphone, a portable media player, a wearable device, etc. However, the embodiments disclosed herein contemplate any technically feasible system configured to implement the functionality of the audio system 3000.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a ""module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a first array of M speaker elements disposed in a cylindrical configuration about an axis and configured to play back audio at a first range of frequencies;

a second array of N speaker elements disposed in a cylindrical configuration about the axis and configured to play back audio at a second range of frequencies; and a digital signal processor, programmed to generate a first plurality of output channels from an input channel for the first range of frequencies, apply the first plurality of output channels to the first array of speaker elements using a first rotation matrix to generate a first beam of audio content at a target angle about the axis, generate a second plurality of output channels from the input channel for the second range of frequencies, and apply the second plurality of output channels to the second array of speaker elements using a second rotation matrix to generate a second beam of audio content at the target angle about the axis, wherein the first rotation matrix includes weighting factors of each of the first plurality of output channels to each of the M speaker elements, the second rotation matrix includes weighting factors of each of the second plurality of output channels to each of the N speaker elements, and a head element of the first array is defined according to the formula head=1+ang div M/360 degrees, where $\theta$=ang modulo M/360 degrees, $\beta=\theta/(M/360 \text{ degrees})$, and $\alpha=1-\beta$, such that the head element receives output weighted by $\alpha$ from a first output channel of the first plurality of output channels and output weighted by $\beta$ from a second output channel of the first plurality of output channels, and elements of the first array adjacent to the head element receive output weighted by $\alpha$ from a second output channel of the first plurality of output channels and output weighted by $\beta$ from a third output channel of the first plurality of output channels.

2. The system of claim 1, wherein, in response to a change in the target angle to a new target angle about the axis, the digital signal processor is programmed to:

update the weighting factors of the first rotation matrix to apply the first plurality of output channels to the first array of speaker elements to generate the first beam of audio content at the new target angle about the axis, and update the weighting factors of the second rotation matrix to apply the second plurality of output channels to the second array of speaker elements to generate the second beam of audio content at the new target angle about the axis.

3. The system of claim 1, wherein M and N are positive integers and have different values from one another.

4. The system of claim 1, wherein the first plurality of distinct output channels is generated using a first set of finite input response filters, and the second plurality of distinct output channels is generated using a second set of finite input response filters.

5. The system of claim 4, wherein the first set of finite input response filters includes a first subset of finite input response filters corresponding to a first beam width and a second subset of finite input response filters corresponding to a second beam width, the second set of finite input response filters includes a third subset of finite input response filters corresponding to the first beam width and a fourth subset of finite input response filters corresponding to the second beam width, the digital signal processor is programmed to select the first and third subsets of finite input response filters responsive to selection of the first beam width, and the digital signal processor is programmed to select the second and fourth subsets of finite input response filters responsive to selection of the second beam width.

6. The system of claim 4, wherein a first of the first set of finite input response filters is configured to generate a first output channel for a first speaker element of the first array of speaker elements at the target angle, a second of the first set of finite input response filters is configured to generate a second output channel for second and third speaker elements of the first array of speaker elements adjacent to the first speaker element, and a third of the first set of finite input response filters is configured to generate a third output channel for fourth and fifth speaker elements of the first array of speaker elements adjacent to the second and third speaker elements.

7. The system of claim 6, wherein a first of the second set of finite input response filters is configured to generate a first output channel for a first speaker element of the second array of speaker elements at the target angle, a second of the second set of finite input response filters is configured to generate a second output channel for second and third speaker elements of the second array of speaker elements adjacent to the first speaker element, and a third of the second set of finite input response filters is configured to generate a third output channel for fourth and fifth speaker elements of the second array of speaker elements adjacent to the second and third speaker elements.

8. A method comprising:

generating a first plurality of output channels from an input channel for a first range of frequencies;

applying the first plurality of output channels, to a first array of M speaker elements disposed in a cylindrical configuration about an axis and playing back audio at a first range of frequencies, using a first rotation matrix to generate a first beam of audio content at a target angle about the axis;

generating a second plurality of output channels from the input channel for the second range of frequencies; and applying the second plurality of output channels, to a second array of N speaker elements disposed in a cylindrical configuration about the axis and playing back audio at a second range of frequencies, using a second rotation matrix to generate a second beam of audio content at the target angle about the axis, wherein the first rotation matrix includes weighting factors of each of the first plurality of output channels to each of the M speaker elements, the second rotation matrix includes weighting factors of each of the second plurality of output channels to each of the N speaker elements, and a head element of the first array is defined according to the formula head=1+ang div M/360 degrees, where $\theta$=ang modulo M/360 degrees, $\beta=\theta/(M/360 \text{ degrees})$, and $\alpha=1-\beta$, such that the head element receives output weighted by $\alpha$ from a first output channel of the first plurality of output channels and output weighted by $\beta$ from a second output channel of the first plurality of output channels, and elements of the first array adjacent to the head element receive output weighted by $\alpha$ from a second output channel of the first plurality of output channels and output weighted by $\beta$ from a third output channel of the first plurality of output channels.

9. The method of claim 8, further comprising, in response to a change in the target angle to a new target angle about the axis:

updating the weighting factors of the first rotation matrix to apply the first plurality of output channels to the first array of speaker elements to generate the first beam of audio content at the new target angle about the axis, and updating the weighting factors of the second rotation matrix to apply the second plurality of output channels to the second array of speaker elements to generate the second beam of audio content at the new target angle about the axis.

10. The method of claim 8, wherein M and N are positive integers and have different values from one another.

11. The method of claim 8, wherein the first plurality of distinct output channels is generated using a first set of finite input response filters, and the second plurality of distinct output channels is generated using a second set of finite input response filters.

12. The method of claim 11, wherein the first set of finite input response filters includes a first subset of finite input response filters corresponding to a first beam width and a second subset of finite input response filters corresponding to a second beam width, the second set of finite input response filters includes a third subset of finite input response filters corresponding to the first beam width and a fourth subset of finite input response filters corresponding to the second beam width, and further comprising selecting the first and third subsets of finite input response filters responsive to selection of the first beam width; and selecting the second and fourth subsets of finite input response filters responsive to selection of the second beam width.

13. The method of claim 11, wherein a first of the first set of finite input response filters is configured to generate a first output channel for a first speaker element of the first array of speaker elements at the target angle, a second of the first set of finite input response filters is configured to generate a second output channel for second and third speaker elements of the first array of speaker elements adjacent to the first speaker element, and a third of the first set of finite input response filters is configured to generate a third output channel for fourth and fifth speaker elements of the first array of speaker elements adjacent to the second and third speaker elements.

14. The method of claim 13, wherein a first of the second set of finite input response filters is configured to generate a first output channel for a first speaker element of the second array of speaker elements at the target angle, a second of the second set of finite input response filters is configured to generate a second output channel for second and third speaker elements of the second array of speaker elements adjacent to the first speaker element, and a third of the second set of finite input response filters is configured to generate a third output channel for fourth and fifth speaker elements of the second array of speaker elements adjacent to the second and third speaker elements.

* * * * *